US005977917A

United States Patent [19]

Hirose

[11] Patent Number: 5,977,917

[45] Date of Patent: Nov. 2, 1999

[54] ANTENNA APPARATUS CAPABLE OF PRODUCING DESIRABLE ANTENNA RADIATION PATTERNS WITHOUT MODIFYING ANTENNA STRUCTURE

[75] Inventor: Masanobu Hirose, Fuchu, Japan

[73] Assignee: Casio Computer Co., Ltd., Tokyo, Japan

[21] Appl. No.: 08/876,867

[22] Filed: Jun. 16, 1997

Related U.S. Application Data

[63] Continuation of application No. 08/550,063, Oct. 30, 1995, abandoned, which is a continuation of application No. 08/232,957, Apr. 25, 1994, abandoned.

[30] Foreign Application Priority Data

| | | | |
|---|---|---|---|
| Apr. 28, 1993 | [JP] | Japan | 5-123193 |
| Oct. 8, 1993 | [JP] | Japan | 5-277427 |

[51] Int. Cl.[6] ..... H01Q 1/24

[52] U.S. Cl. ..... 343/702; 343/722; 343/831

[58] Field of Search ..... 343/831, 702, 343/722, 790, 791, 749; 455/90; H01Q 1/24

[56] References Cited

U.S. PATENT DOCUMENTS

| | | | |
|---|---|---|---|
| 2,828,413 | 3/1958 | Bowers | 343/702 |
| 3,980,952 | 9/1976 | Rapshys | 325/16 |
| 4,509,056 | 4/1985 | Ploussios | 343/791 |
| 4,590,614 | 5/1986 | Erat | 455/270 |
| 4,644,366 | 2/1987 | Scholz | 343/702 |
| 4,721,962 | 1/1988 | Gorzel | 343/702 |
| 5,038,405 | 8/1991 | Karr | 343/745 |
| 5,072,230 | 12/1991 | Taniyoshi et al. | 343/722 X |
| 5,231,412 | 7/1993 | Eberhardt et al. | 343/790 |
| 5,311,201 | 5/1994 | Lillie et al. | 343/791 |
| 5,317,327 | 5/1994 | Piole | 343/790 X |
| 5,335,368 | 8/1994 | Tamura | 343/702 X |

FOREIGN PATENT DOCUMENTS

| | | | |
|---|---|---|---|
| 0214806 | 3/1987 | European Pat. Off. | H01Q 1/24 |
| 0548975 A1 | 6/1993 | European Pat. Off. . | |

OTHER PUBLICATIONS

IEEE Antennas & Propagation Society International Symposium, Jul. 20, 1992, U.S.A., pp. 65–68, XP342313, Sekine et al, "The Radiation Characteristic of a /4 Monopole Antenna, Mounted on a Conducting Body With a Notch".

Proceedings of PIMRC '93, Yokohama, Japan, Sep. 8–11, 1993, pp. 557–561, Gain Enhancement of λ/4 Monopole Antenna on a Handset by Passive Loading, presented by Masanobu Hirose, et al.

Proceedings of ICUPC '93, Ottawa, Canada, Oct. 12–15, 1993, pp. 44–48, Pattern Control of a 1/4λ Monopole Antenna on a Handset by Passive Loading, presented by Mananobu Hirose, et al.

IEEE AP–Symposium Digest, Chicago, Ilinois, USA, Jul. 20–24, 1992, pp. 65–68.

*Primary Examiner*—Don Wong
*Assistant Examiner*—Tho Phan
*Attorney, Agent, or Firm*—Frishauf, Holtz, Goodman, Langer & Chick, P.C.

[57] ABSTRACT

A portable communication system includes a first metal housing for containing a high frequency circuit unit such as a transmitting circuit and a receiving circuit, a second metal housing for containing a low frequency circuit unit such as a control circuit, and also an antenna mounted on the first metal housing. An antenna apparatus for this portable communication system is arranged by the above-explained antenna, first and second metal housings, and also a control element for controlling distribution of high frequency currents flowing through the first and second metal housings. An antenna radiation pattern of this antenna apparatus can be optimized by controlling an impedance of the control element.

63 Claims, 25 Drawing Sheets

ANTENNA APPARATUS CAPABLE OF PRODUCING DESIRABLE ANTENNA RADIATION PATTERNS WITHOUT MODIFYING ANTENNA STRUCTURE

This application is a Continuation of application Ser. No. 08/550,063, now abandoned filed Oct. 30, 1995, which is a Continuation of application Ser. No. 08/232,957 filed Apr. 25, 1994 (now abandoned).

BACKGROUND OF THE INVENTION

1. Field of the Invention

The present invention generally relates to an antenna apparatus used in a portable communication apparatus. More specifically, the present invention is directed to a structure of an antenna apparatus capable of producing desirable antenna radiation patterns without modifying the antenna structure.

2. Description of Prior Art

As is well known in the field, an electromagnetic radiation pattern of an antenna would be varied when a conductive article would be located adjacent to this antenna, since a high-frequency current may flow through the antenna during transmission/reception of electromagnetic waves.

Therefore, to obtain a desirable radiation pattern of the antenna, effect of the conductive member in the vicinity of the antenna should be taken into consideration. For example, in the portable communication apparatus, since a circuit board is provided with a grounding conductive layer of a comparatively large surface area, the effect of such grounding conductive layer should be taken into consideration. In recent, to protect the circuit boards from external electromagnetic effect, portable communication apparatus are provided with an electromagnetic shield plate or such circuit boards are installed within a metal housing. But, in the portable communication apparatus, attention should be paid to effects of the electromagnetic shield plate and the metal housing.

FIG. 1 is a view illustrating a structure of antenna apparatus which has been proposed recently. The antenna apparatus draws much attention in the art, since the antenna apparatus is effective to obtain a desirable radiation pattern, and is often used for a communication apparatus of a type in which the circuit board is electromagnetically shielded with a metal housing.

As shown in FIG. 1, the antenna apparatus is composed of an antenna 1 (a so called $\lambda/4$ monopole antenna) having a length of one fourth of a wave length and a metal housing 2 formed with a notch 3 in the side wall thereof. The notch 3 is formed with an opening end 3*a* in the side wall thereof. The notch 3 is formed in the side wall of the metal housing at a position apart by a length of $\lambda/4$, i.e., a length of $0.25\lambda$ from the upper surface on which an electric supplying point 1*a* is provided. The notch 3 has a depth of $0.25\lambda$, and the ceiling and bottom composing the notch 3 are connected by an end wall (the leftend wall as viewed in FIG. 1). Therefore, the notch 3 has a stub function.

Then, the portion defined from the uppermost portion of the right side surface of the metal housing to the opening end 3*a* of the notch 3, namely the portion having the length of $0.25\lambda$ will be cooperated with the $\lambda/4$ monopole antenna 1, which are therefore operated like a $\lambda/2$ dipole antenna.

The above-described conventional antenna apparatus requires the notch 3 having the depth of $0.25\lambda$ (wavelengths). As a result, the horizontal (transverse) width 1 of the metal housing 2 necessarily becomes longer than $0.25\lambda$, which may impede compactness of the metal housing 2.

As to the manufacturing stages of the conventional antenna apparatus, when another antenna apparatus is manufactured which is operable in another frequency different from that of the above-described conventional antenna apparatus by changing the length of the above-described $\lambda/4$ monopole antenna 1, a length from an upper surface of a metal housing to an opening end should be varied in order to be fitted to this new frequency. As a consequence, there are drawbacks in the conventional antenna apparatuses that various metal housings whose notch forming positions are different from each other should be manufactured, depending upon the frequencies of the electromagnetic waves used in the communications.

SUMMARY OF THE INVENTION

An object of the present invention is to provide a compact antenna apparatus capable of producing a better radiation pattern.

Another object of the present invention is to provide an antenna apparatus capable of controlling a radiation pattern without modifying an antenna structure.

A further object of the present invention is to provide an antenna apparatus with less limitations in a constructive matter and a mounting way, while producing a better radiation pattern.

To achieve the above-described objects, an antenna apparatus, according to one aspect of the present invention, comprises:

a first conductor;

an antenna mounted on said first conductor;

a second conductor separately provided with said first conductor; and a control element electrically connected between said first conductor and said second conductor, for controlling distribution of high frequency currents flowing through said first and second conductors.

BRIEF DESCRIPTION OF THE DRAWINGS

For a better understanding of the present invention, reference is made of the detailed description to be read in conjunction with the accompanying drawings, in which.

DETAILED DESCRIPTION OF THE PREFERRED EMBODIMENTS

With reference to the drawings, antenna apparatuses according to presently preferred embodiments of the present invention will now be described.

Figure 1:
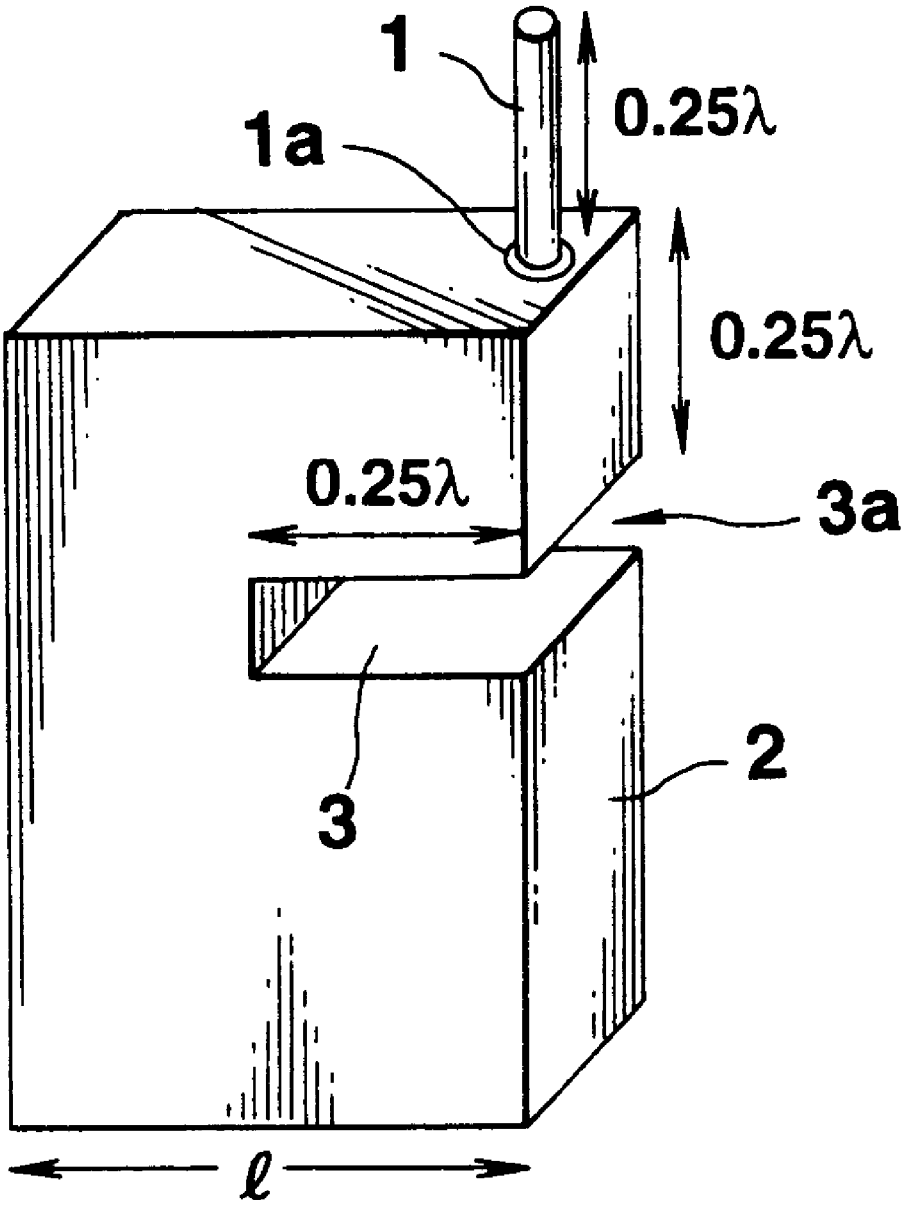
FIG.1 PRIOR ART
FIG. 1 represents the structure of the conventional antenna apparatus.
Figure 2A:
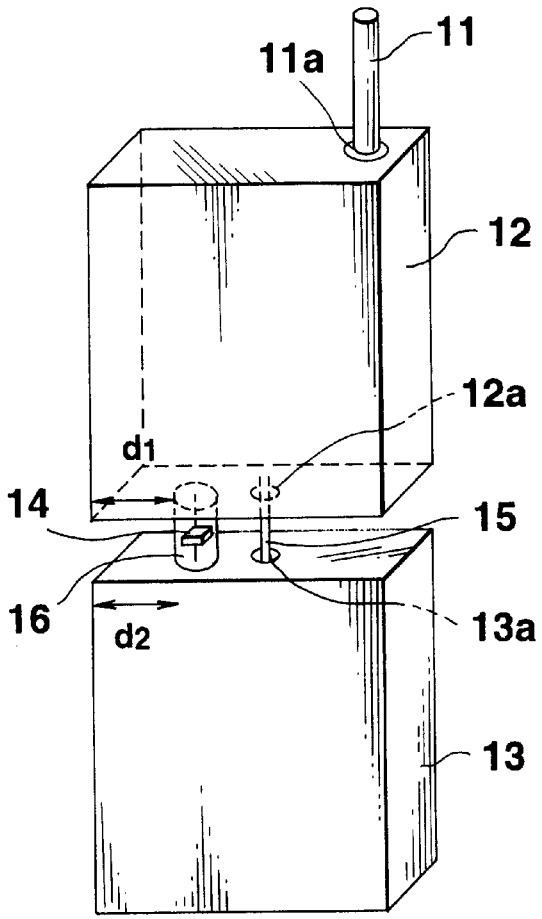
FIGS. 2A and 2B schematically show structures of an antenna apparatus according to a first embodiment of the present invention.
Figure 2B:
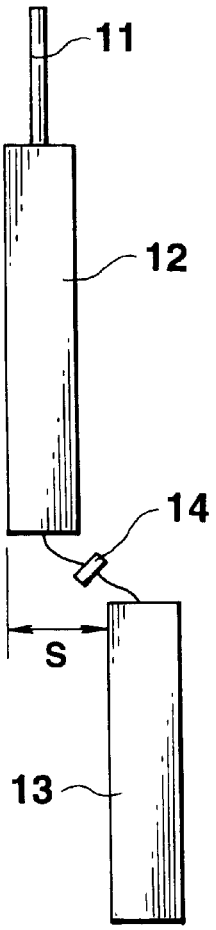

FIGS. 2A and 2B schematically show a structure of an antenna apparatus according to a first embodiment of the present invention. The antenna apparatus according to this first embodiment is arranged by, as represented in FIG. 2A, a monopole antenna 11, a main conductive housing 12 (for example a main metal housing), on which upper surface a feeding point 11*a* for this monopole antenna 11 is formed, a sub-conductive housing (for instance, a sub-metal housing) 13 independently provided with this main conductive housing 12, and a control element 14. The control element 14 is connected between the main metal housing 12 and the sub-metal housing 13, and controls a current distribution of a high frequency current flowing through the main metal housing 12 and the sub-metal housing 13.

In this embodiment, both the main metal housing 12 and the sub-metal housing 13 are made by mechanically processing metal plates. Alternatively, either an outer surface, or an inner surface of a resin housing may be metal-plated to fabricate these conductive housings 12 and 13. Within the main metal housing 12, a high frequency circuit portion such as a transmitter circuit and a receiver circuit is stored. Within the sub-metal housing 13, other circuits, typically a low frequency circuit portion such as a control circuit and a power supply circuit are stored. The high frequency circuit unit stored within the main metal housing 12 is connected to the other circuit unit stored in the sub-metal housing 13 by way of a circuit connecting line 15 penetrating through a through hole 12*a* formed in the metal housing 12 and a through hole 13*a* formed in the metal housing 13. The connection structure will be described more in detail with reference to FIG. 3 to FIG. 7, and is so designed that the main metal housing 12 is not shortcircuited with the sub-metal housing 13 via the circuit connecting line 15 in view of high frequency signals.

The control element 14 is stored in a circular tube 16 made of a resin, one end of which is connected to the lower surface of the main metal housing 12 and the other end of which is connected to the upper surface of the sub-metal housing 13. It should be noted that when both the main metal housing 12 and the sub-metal housing 13 are manufactured by metal-plated resin housings, the control element 14 is connected to the respective metal-plated portions of these resin housings.

As previously explained, the control element 14 has such a function to control the current distributions of the high frequency currents flowing through the main metal housing 12 and the sub-metal housing 13 while electromagnetic waves are transmitted and received. Therefore, passive elements such as a resistor, a capacitor and a coil, and also a negative-resistance element, such as an ESAKI tunnel diode may be employed as this control element 14. When an attention is paid to the characteristics and also the cost of the control element 14, a capacitor and a coil are preferable as this control element 14.

In case of this first embodiment, the control element 14 and the connection line thereof are stored in the circular tube 16 made of a resin, whereas since the main metal housing 12 and the sub-metal housing 13 are fixed to a predetermined positional relationship (will be discussed later), they may be provided without any sheath.

In general, when a monopole antenna is employed as this antenna, the connecting position of the control element 14 with regard to the main metal housing 12 and the sub-metal housing 13 is preferably the farmost position apart from the antenna setting position on the main metal housing 13. That is, as illustrated in FIG. 2A, when the monopole antenna 11 is positioned to the right end of the upper surface of the main metal housing 12, it is desirable that the control element 14 is connected to the left end of the lower surface of the main metal housing 12. However, the connection position of the control element 14 is not limited to the above-explained position. For instance, a connection position between the control element 14 and the main metal housing 12 is set to a distance "d1" measured from the left end of the main metal housing 12, whereas another connection position between the control element 14 and the sub-metal housing 13 is set to another distance "d2" measured from the left end of this sub-metal housing 13, wherein the first distance "d1" is not equal to the second distance "d2". It should also be noted that the shapes of these main metal housing 12 and sub-metal housing 13, and also the arranging relationships thereof may be different from those of FIG. 2A. For instance, as illustrated in FIG. 2B, the main metal housing 12 is positionally shifted from the sub-metal housing 13 by a distance "S" along the horizontal direction.

Actually, the antenna apparatus according to the first embodiment is stored within a resin case of a portable communication apparatus.

As is known in the communication field, shapes and positional relationships of the main metal housing 12 and the sub-metal housing 13, as well as connection positions of the control element 14 with respect to both of these metal housings 13 and 14 may give influences to the current distributions of the high frequency currents flowing through the main metal housing 12 and the sub-metal housing 13, in other words, to the electromagnetic-wave radiation patterns of the antenna which are the same as the impedance value of the control element 14. As a consequence, the shapes and positional relationship of these metal housings 12 and 13, the connection positions of the control element 14 to these metal housings, and also the impedance value of the control element 14 should be determined in such a manner that the optimum antenna characteristics can be achieved under conditions where the antenna apparatus of the present invention is actually mounted on a case of a portable communication apparatus. In this case, the impedance value of the control element 14 may be varied without giving any influences to the shape of the antenna apparatus. In other words, the change of the impedance value of the control element 14 may be achieved by substituting the control element 14 having one impedance value by the control element 14 having another different impedance value. As a consequence, even when such an optimum positional relationship or the like between the main metal housing 12 and the sub-metal housing 13 could not be achieved due to restrictions in designing of the main body made of resin for storing the antenna apparatus, the antenna characteristics may be selected, or approximated to the optimum values thereof by properly selecting the impedance value of the control element 14.

When the main metal housing 12 is positionally shifted from the sub-metal housing 13 along the front/rear direction (namely, horizontal direction as viewed in FIG. 2B), since the front-to-rear ratio (i.e., the ratio of the antenna gain for the antenna apparatus on the front side thereof to the antenna gain thereto on the rear side thereof) of the antenna radiation gain is varied, the further preferable antenna characteristic may be achieved if the front-to-rear shift direction between the main metal housing 12 and the sub-metal housing 13 would be set in order that the antenna gain on the side opposite to an operator will be increased, while this antenna apparatus is actually mounted on the communication case.

As the method for fixing the main metal housing 12 and the sub-metal housing 13 in the preset optimum arranging relationship, there are available a method for integrally molding the metal housings 12 and 13, and a method for separately fixing the metal housings 12 and 13 to the communication unit case by a screw.

In the antenna apparatus constructed in the above-described manner, when the monopole antenna 11 is energized from the feeding point 11*a,* a current is distributed on monople antenna 11, so that electromagnetic waves are radiated from this monopole antenna 11. In response to this radiation of the electromagnetic waves, the main metal housing 12 and the sub-metal housing 13 are energized, so that currents are also distributed on these metal housings and thus electromagnetic waves are radiated therefrom. The current distributions occurred in this time respond to the impedance of the control element 14 used to electrically couple the main metal housing 12 with the sub-metal housing 13. Similarly, the antenna radiation pattern will respond to this impedance.

In case that the above-described control element 14 would be designed to essentially have only a reactance component (namely, inductance and capacitance components only), i.e., not to essentially have a resistance component, a loss in the portion of the control element 14 is negligible.

Next, referring to FIG. 3 to FIG. 7, a description will be made of a structure for electrically opening a circuit connecting line 15 from both of the main metal housing 12 and the sub-metal housing 13. The circuit connecting line 15 is to connect the circuit unit stored within the main metal housing 12 to the circuit unit stored within the sub-metal housing 13.

Figure 3A:
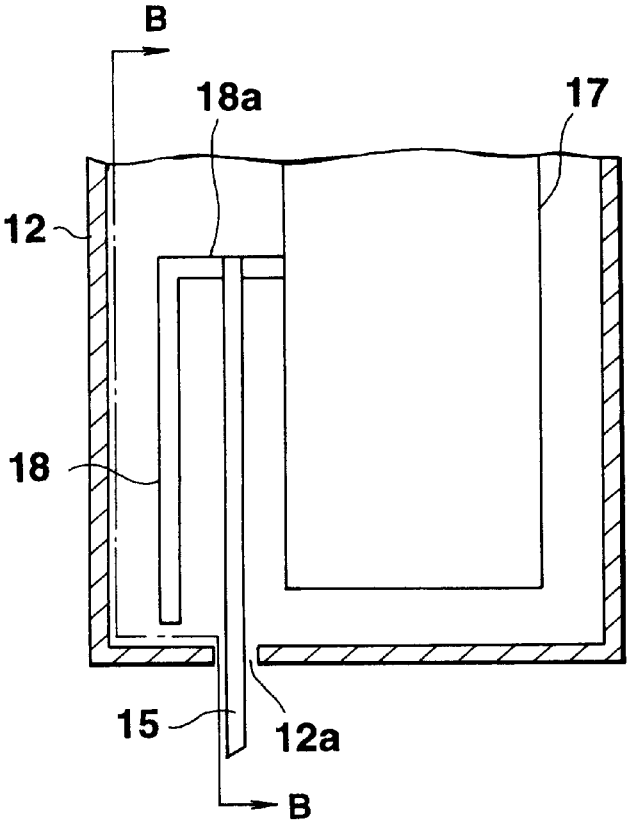
FIGS. 3A and 3B schematically indicate a first constructive example for electrically opening a circuit connecting line for connecting a circuit employed within a main metal housing with a circuit employed within a sub-metal housing from both the main and sub-housings.
Figure 3B:
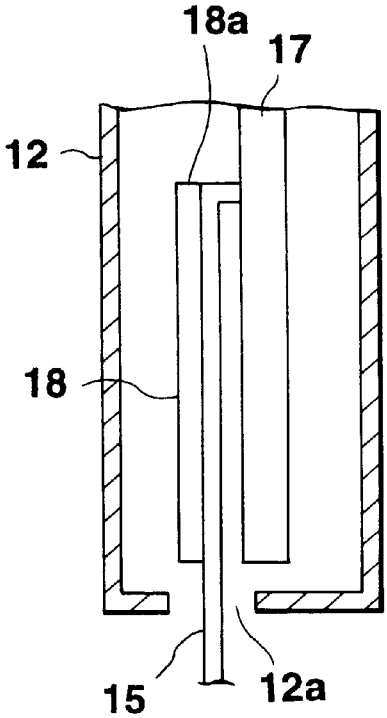

FIG. 3 schematically shows a first structural example. FIG. 3A is a front view of one metal housing, for example, the main metal housing 12 whose one surface has been taken out. FIG. 3B is a sectional view of this metal housing, taken along a line 3B—3B of FIG. 3A. As illustrated in FIG. 3, the circuit connecting line 15 has one end connected to a connection terminal of a circuit board 17 employed in the main metal housing 12, and also the other end which passes through a through hole 12*a* formed in this main metal housing 12 and is extracted outside this main metal housing 12. Then, ¼λ open stub 18 having a portion located near the above-described though hole 12*a,* as an opening end, is arranged to be connected to the circuit connecting line 15 at a base portion 18*a*. It should be noted that although not shown in the drawing, the above-described other end of the circuit connecting line 15 extracted from the main metal housing 12, is penetrated through another through hole formed in the sub-metal housing 13, and then is conducted into this sub-metal housing 13, thereby being connected to a connection terminal of a circuit board provided within the sub-metal housing 13. Also, within this sub-metal housing 13, another ¼λ open stub similar to the above-mentioned ¼λ open stub 18 is provided in a similar positional relationship.

In accordance with the above-explained structure, a radio frequency current (namely, current with frequency under use) flowing over an outer surface of the metal housing 12, does not flow into the circuit connecting line 15, because the ¼λ open stub 18 is present. As a result, no radio frequency (RF) current flows from the main metal housing 12 via the circuit connecting line 15 to the sub-metal housing 13. It should be understood that since, normally, a plurality of circuit connecting lines are employed to connect these two metal housings 12 and 13 with each other in the portable communication apparatus, each of these circuit connecting lines is connected by way of the above-described arrangement.

Figure 4A:
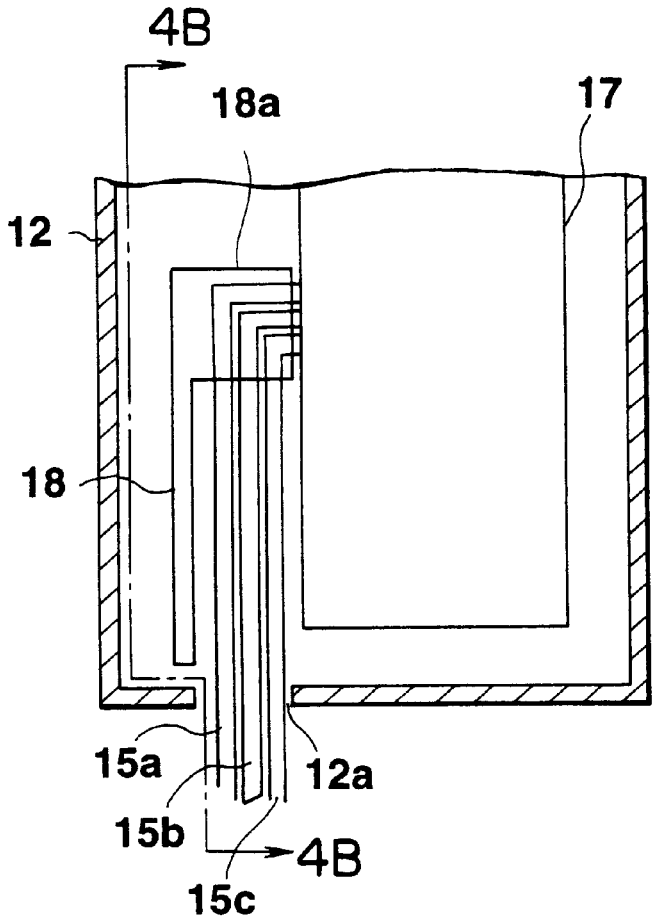
FIGS. 4A and 4B schematically represent a second constructive example of electrically opening a circuit connecting line for connecting a circuit employed within a main metal housing with a circuit employed within a sub-metal housing from both the main and sub-housings.
Figure 4B:
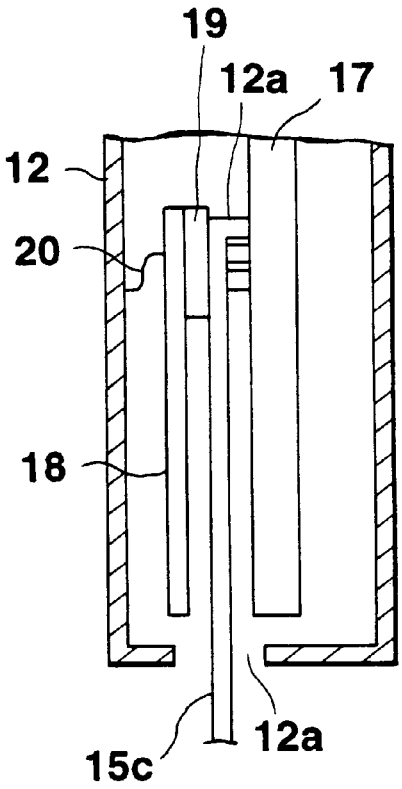

FIG. 4 schematically shows a second structural example. FIG. 4A is a front view of the main metal housing 12 whose one surface has been taken out, and FIG. 4B is a sectional view thereof, taken along a line 4B—4B of FIG. 4A. This second structural example shows such a structure of ¼λ open stub 18 being arranged when a plurality of circuit connecting lines are employed. As illustrated in FIG. 4, a plurality of circuit connecting lines 15*a* to 15*c* are extracted from the circuit board 17 outside the main metal housing 12. The ¼λ open stub 18 of this structure has a base portion 18*a* whose width is wide. Then, ¼λ open stub 18 is connected via a dielectric substance 19 to the plural circuit connecting lines 15*a* to 15*c* at this base portion 18*a*. It should be noted that since this ¼λ open stub 18 is not directly and electrically connected to the circuit connecting line 15 at this time similar to the ¼λ open stub 18 of FIG. 3, the first-mentioned ¼λ open stub 18 is shortcircuited via a conductive line 20 to the main metal housing 12. As a result, no RF current flows through the circuit connecting lines 15*a* to 15*c* in a similar condition to that of the first structural example.

Figure 5A:
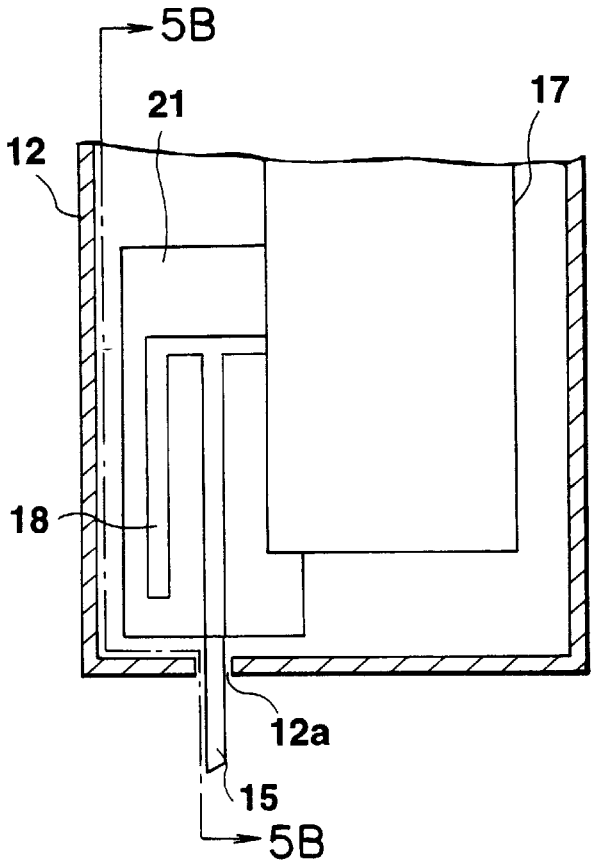
FIGS. 5A and 5B schematically show a third constructive example for electrically opening a circuit connecting line for connecting a circuit employed within a main metal housing with a circuit employed within a sub-metal housing from both the main and sub-housings.
Figure 5B:
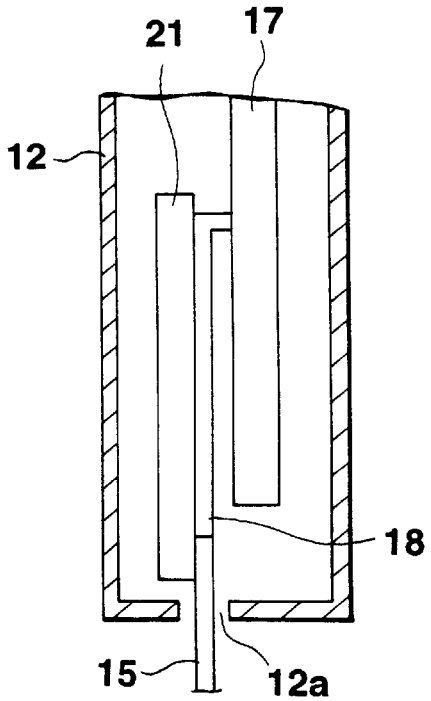

FIG. 5 schematically indicates a third structural example. FIG. 5A is a front view of the main metal housing 12 whose one surface has been taken out, and FIG. 5B is a sectional view thereof, taken along a line 5B—5B shown in FIG. 5A. This third structural example is very similar to the first structural example except that the ¼λ open stub 18 shown in FIG. 3 and a portion of the circuit connecting line 15 are formed on a printed circuit board 21, so that a similar effect to that of the first structural example can be obtained. In addition thereto, since a portion of the circuit connecting line 15 and the ¼λ open stub 18 are formed on the printed board 21, there is another merit that as the structural feature, this portion becomes strong in view of the structural aspect. It should be noted that when a plurality of circuit connecting lines 15 are formed on the print board 21, ¼λ open stub 18 is formed similar to the second structural example shown in FIG. 4 in such a manner that the base portion thereof is made from a plate-shaped member with a wide width, and a plurality of circuit connecting lines are connected via the dielectric substance at this base portion.

Figure 6A:
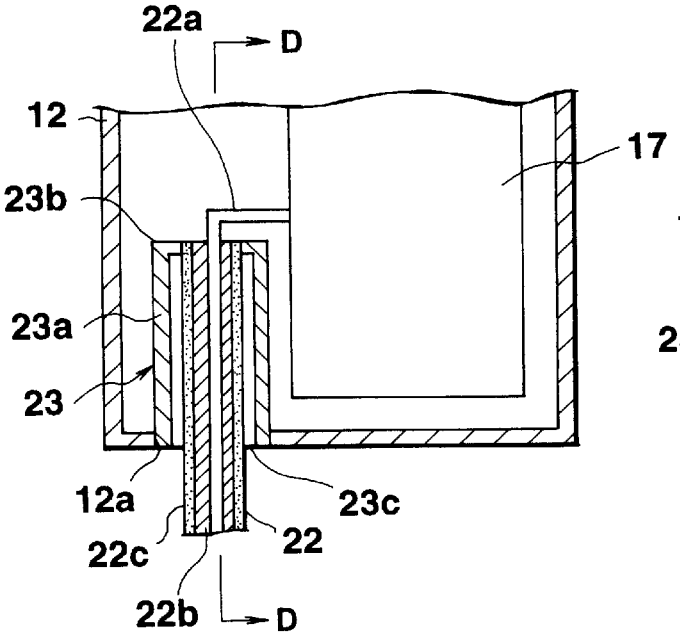
FIGS. 6A and 6B schematically indicate a fourth constructive example for electrically opening a circuit connecting line for connecting a circuit employed within a main metal housing with a circuit employed within a sub-metal housing from both the main and sub-housings.
Figure 6B:
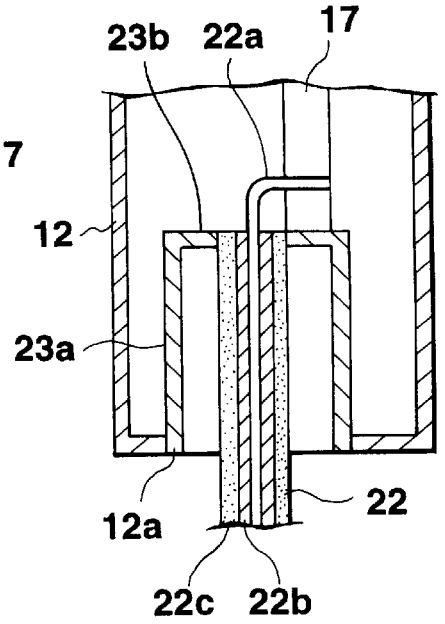

FIG. 6 schematically illustrates a fourth structural example. FIG. 6A is a front view of the main metal housing 12 whose one surface has been taken out, and FIG. 6B is a sectional view thereof, taken along a line 6B—6B of FIG. 6A. In this fourth structural example, a coaxial cable 22 is employed as the circuit connecting line 15. As shown in FIGS 6A and 6B, an opening portion 23*c* of a sleeve 23*a*, which has a length of ¼λ (hereafter referred to as a ¼λ sleeve), is electrically connected to the through hole 12*a* of the main metal housing 12. Then, one end portion of an internal conductor 22*a* of the coaxial cable 22 functioning as the circuit connecting line 15 is connected to the connecting terminal of the circuit board 17 provided within the main metal housing 12. An outer conductor 22*c* of the coaxial cable 22 which is electrically insulated via an insulating layer 22*b* from an inner conductor 22*a* thereof, is electrically connected to a shortcircuiting lid portion 23*b* of the sleeve 23*a*.

In accordance with this fourth structure, as previously explained, since the ¼λ sleeve is employed and the coaxial cable 22 is penetrated through this ¼λ and then extracted outside the main metal housing 12, it is achieved that the RF current flowing through the outer surface of this metal housing 12 does not flow via the outer conductor 22*c* of the coaxial cable 22 through the other sub-metal housing 13. Additionally, since the ¼λ sleeve is utilized, the inside of the main metal housing 12 is completely shielded from the outer space, so that the shielding effect could be considerably improved. It should be noted that when a plurality of circuit connecting lines are employed, such a coaxial cable having a plurality of inner conductors may be utilized.

Figure 7:
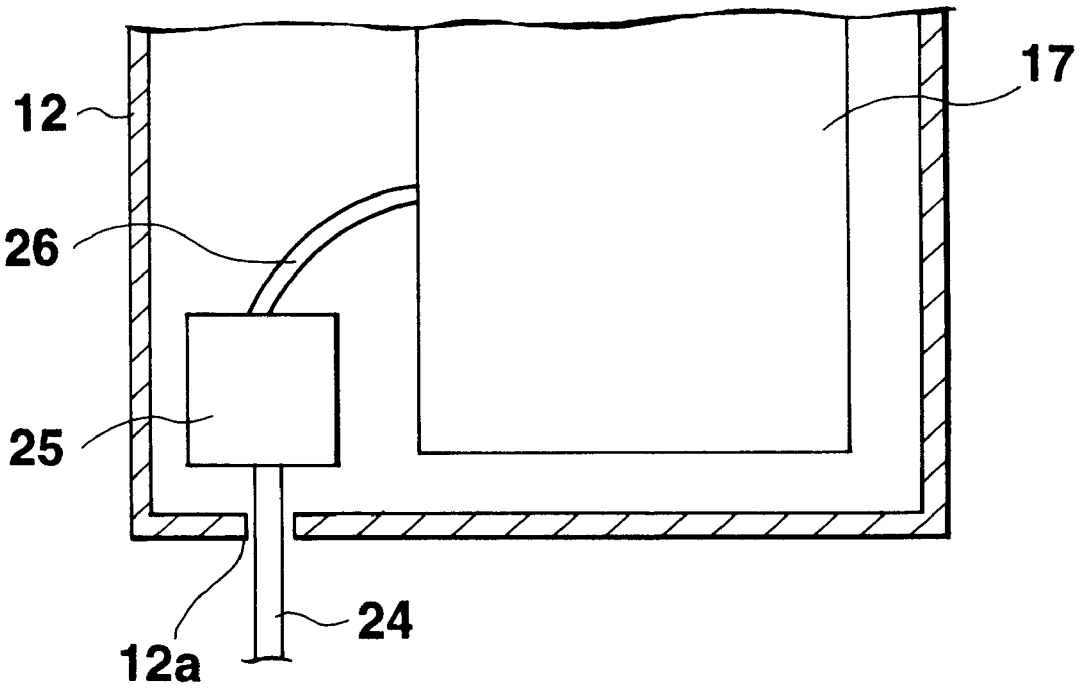
FIG. 7 schematically represents a fifth constructive example for electrically opening a circuit connecting line for connecting a circuit employed within a main metal housing with a circuit employed within a sub-metal housing from both the main and sub-housings.

FIG. 7 schematically indicates a fifth structural example, namely a front view of the main metal housing 12 whose one surface is taken out. In this fifth structural example, an optical fiber 24 is used as the circuit connecting line 15. As illustrated in FIG. 7, an electric signal derived from the circuit board 17 employed within the metal housing 12 is supplied via a connecting line 26 to an optical/electric converter 25. Then, this electric signal is converted into an optical signal by the optical/electric converter 25. Accordingly, the resultant optical signal is transferred via the optical fiber 24 to the other sub-metal housing 13. This optical fiber 24 is penetrated through the through hole 12*a* formed in the metal housing 12 and then extracted outside this metal housing 12. An optical signal sent from the sub-metal housing 13 via the optical fiber 24 is converted by way of the optical/electric converter 25 into the electric signal, and this electric signal is transferred via the connecting line 26 to the circuit board 17.

With such a fifth structure, since the optical fiber 24 is the insulating material, no RF current may flow from the outer surface of the main metal housing 12 via the optical fiber 24 to the sub-metal housing 13. When the optical/electric converter 25 has the multiplexing function, only one optical fiber may be required even when signals are transmitted/received at the same time.

Figure 8A:
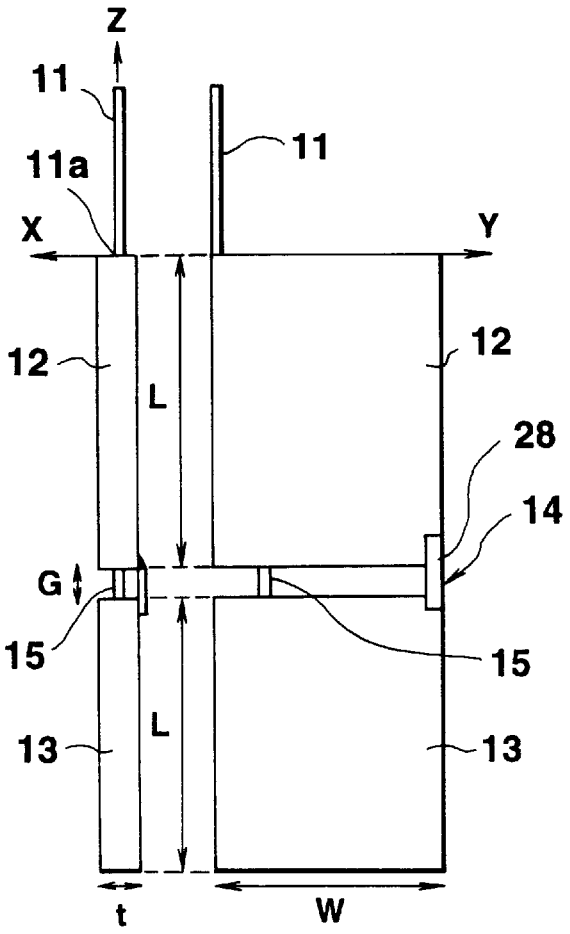
FIGS. 8A and 8B schematically indicate another antenna apparatus according to a second embodiment of the present invention.
Figure 8B:
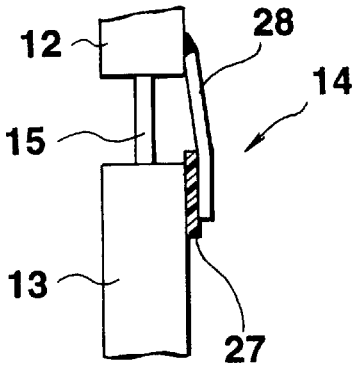

FIG. 8 schematically shows a construction of an antenna apparatus according to a second embodiment of the present invention. FIG. 8A shows a front surface and a left side surface of this antenna apparatus. FIG. 8B represents in detail a connection portion of a control element 14 with regard to the main metal housing 12 and the sub-metal housing 13. It should be noted that the same reference numerals shown in FIG. 2 will be employed as those for denoting the same or similar constructive elements.

In this second embodiment, since the monopole antenna 11 is provided on the upper left end portion of the main metal housing 12, the control element 14 is provided in such a manner that a lower right portion of the main metal housing 12 is connected with an upper right portion of the sub-metal housing 13. It should also be noted that the circuit connecting line 15 for connecting the circuit employed in the main metal housing 12 with the circuit employed in the sub-metal housing 13, owns such an extracting structure that the metal housings 12 and 13 are not shortcircuited with each other in view of the high frequency aspect.

As illustrated in FIG. 8B, the control element 14 according to this second embodiment is constructed by a capacitor. This capacitor is formed in such a manner that a dielectric plate 27 is interposed between an upper right end portion of a front surface of the sub-metal housing 13, and a lower end portion of a metal plate 28 whose upper end portion is directly and electrically connected to a lower right portion of a front surface of the main metal housing 12. Then, an impedance value of this capacitor is selected to be a value at which an optimum antenna radiation pattern within the horizontal plane can be obtained. It is, of course, possible to employ a chip capacitor, instead of this dielectric plate 27. An adhesive connection between the dielectric plate 27 and the sub-metal housing 13, and another adhesive connection between the dielectric plate 27 and the metal plate 28 may be performed by way of a conductive adhesive agent or adhesive resin agent. Another connection between the metal plate 28 and the main metal housing 12 may be performed by means of soldering and welding.

The featured antenna construction of the second embodiment is one of the most simple constructions when a chip type element is utilized as the control element 14. Other chip type elements, namely a chip resistor and a chip coil may be similarly employed.

Referring now to FIG. 9 to FIG. 13, a description will be made of simulation results of the antenna apparatuses according to the present invention.

Figure 9:
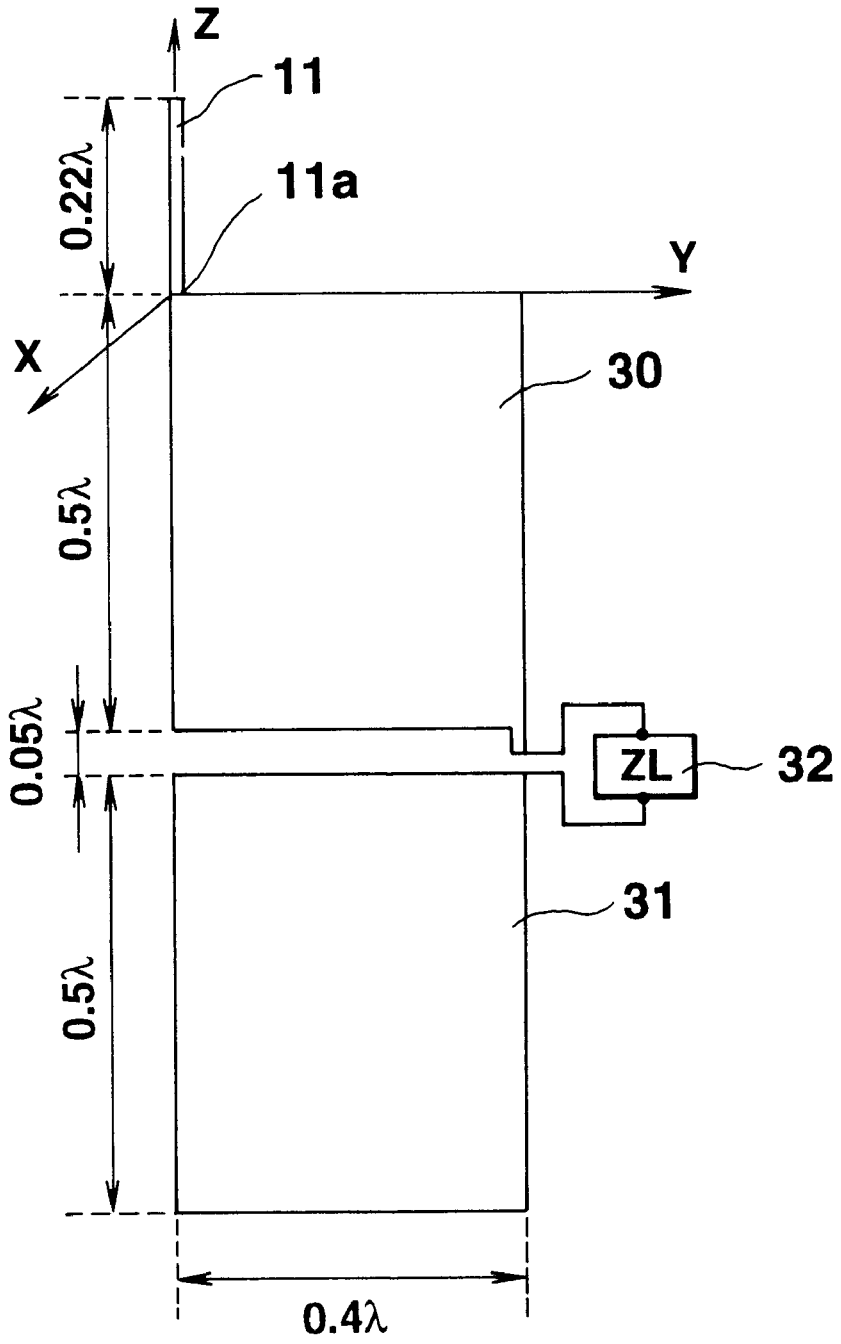
FIG. 9 is a schematic diagram of an experimental model of an antenna apparatus according to the present invention.

FIG. 9 schematically illustrates a structure of a simulation model. In this embodiment, two simulation models have been considered. The first simulation model is constructed in such a manner that two conductive members 30 and 31 are separated from each other by 0.05λ ("λ" being a waveform corresponding to a center frequency under use in the below-mentioned descriptions), the vertical length of which is selected to be 0.5λ, the horizontal length of which is selected to be 0.4λ, and the thickness of which is selected to be 0.3 mm. Furthermore, the monopole antenna 11 is provided on an upper left end portion of the first conductive member 30, and a lower right end portion of the first conductive member 30 is connected via a passive load (passive element) 32 with an upper right end portion of the second conductive member 31. In other words, the first simulation model corresponds to such a simulation model that the vertical length "L", the horizontal length "W", and the thickness "t" of the main and sub-metal housings 12 and 13 employed in the antenna apparatus shown in FIG. 8 are selected to be 0.5λ, 0.4λ, and 0.3 mm respectively, and a space "G" between these metal housings is selected to be 0.05λ.

The second simulation model is such a model that a box shape having a thickness of 10 mm is constructed of the first and second conductive members 30 and 31. That is, the second simulation model corresponds to such a model that the vertical length "L", the horizontal length "W", and the thickness "t" of the metal housings 12 and 13 employed in the antenna apparatus shown in FIG. 8 are selected to be 0.5λ, 0.4λ and 10 mm, respectively, and also a space "G" between both of these metal housings 12 and 13 is selected to be 0.05λ. In this second simulation model, the communication circuit is not stored with the first and second conductive members 30 and 31, but also no circuit connecting lines are employed. However, since the antenna apparatus shown in FIG. 8 has such a structure that the main metal housing 12 is not shortcircuited to the sub-metal housing 13 via the connecting line 15 with respect to the high frequency current, this second model perfectly corresponds to the antenna apparatus illustrated in FIG. 8. The monopole antenna 11 used in the first and second simulation models has the length of 0.22λ and the diameter of 0.0025λ, and a cylinder shape.

The simulation was carried out for the above-explained two models under such conditions that the experimental frequency was selected to be 1.9 GHz, the real part of the impedance of the passive load 32 was selected to be 0 to 10 Kiloohms, and the imaginary part thereof was selected to be −10 Kiloohms to +10 Kiloohms. As a result, it could be found that when the real part of this passive load's impedance was zero ohm, namely this impedance contained only reactance component, the optimum experimental results could be obtained. In the above-described simulation models, when the reactance component was −250 ohms, the actual measurement was carried out.

Figure 10:
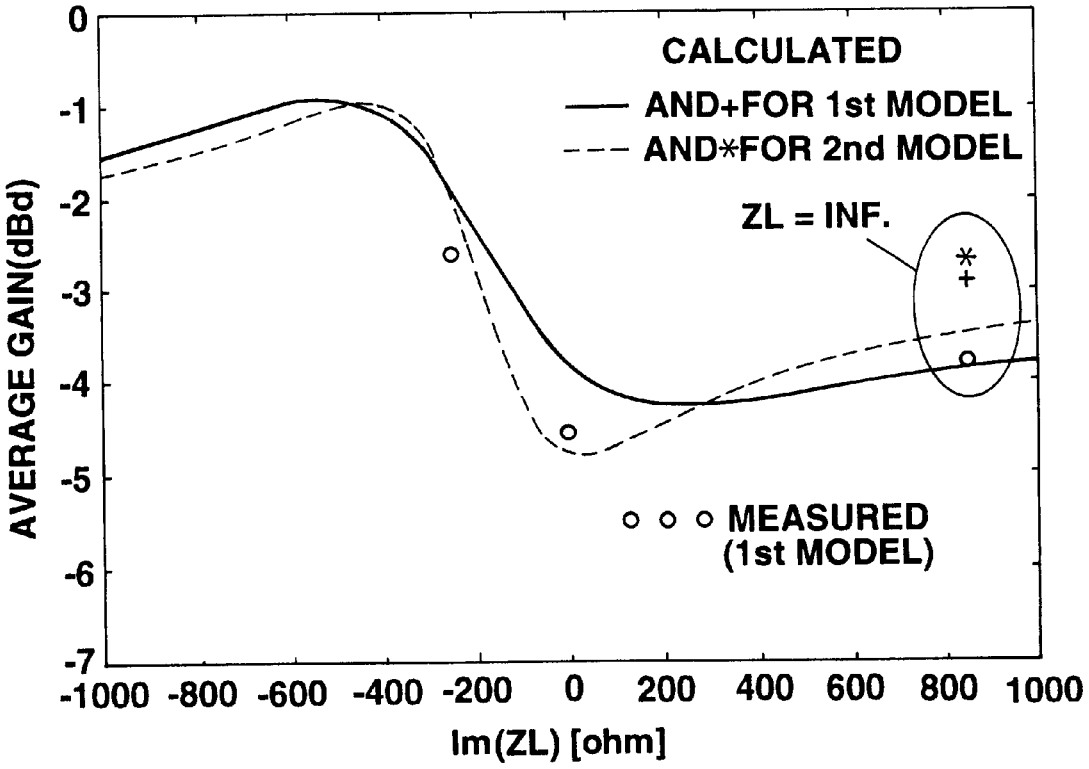
FIG. 10 represents a reactance/average gain characteristic in the experimental mode shown in FIG. 9.

FIG. 10 and FIG. 11 graphically illustrate calculation results and measurement results as to the antenna gains (radiation gains of electromagnetic waves) under such a condition that the real part of the impedance of the passive load 32 was selected to be zero ohm.

FIG. 10 indicates calculation results of averaged radiation gains for the above-described two simulation models within the X- Y plane under such conditions that the real part of the impedance of the passive load 32 is selected to be zero ohm, whereas the imaginary part thereof is shifted within a range from −1 Kiloohms to +1 Kiloohms. It should be noted that as shown in FIG. 9, the X axis of this coordinate system indicates the thickness of the conductive member 30, the Y axis thereof shows the horizontal direction of this conductive member 30, and the Z axis thereof denotes the direction parallel to the axis of the antenna 11. It should be understood that generally speaking, since the antenna apparatus employing the monopole antenna 11 is used under such a condition that the axis of the monopole antenna 11 is essentially directed to the vertical direction, an X-Y plane essentially implies the horizontal plane. Also, the averaged gain implies the predicted gain value of the antenna under such an assumption that vertically polarized radio electromagnetic waves uniformly would reach in an omnidirection within the horizontal plane (X-Y plane).

In FIG. 10, an abscissa of this coordinate system shows the value of the imaginary part (reactance $Z_L$) of the passive load 32, whereas an ordinate thereof denotes the averaged radiation gain. Furthermore, a solid line of FIG. 10 shows calculated values of the first model (namely, the thickness of the conductive member is selected to be 0.3 mm), and a broken line indicated calculated values of the second model (namely, the thickness of the conductive member is selected to be 10 mm). Symbol "o" indicates the actually measured values in the first model. In FIG. 10, the following three measured values are indicated by such cases that the reactance $Z_L$ is −j250 ohms, the reactance $Z_L$ is zero ohm (i.e., both of the first and second conductive members are shortcircuited), and the reactance $Z_L$ is infinite (namely, the passive load 32 is not connected between the first and second conductive members).

As apparent from FIG. 10, the calculated values represent peaks in the range from −j300 ohms to −j600 ohms for both of the first and second simulation models irrelevant to the thicknesses of the first and second conductive members 30 and 31. Also, the actually measured values represent values substantially equal to these calculated values.

Figure 11A:
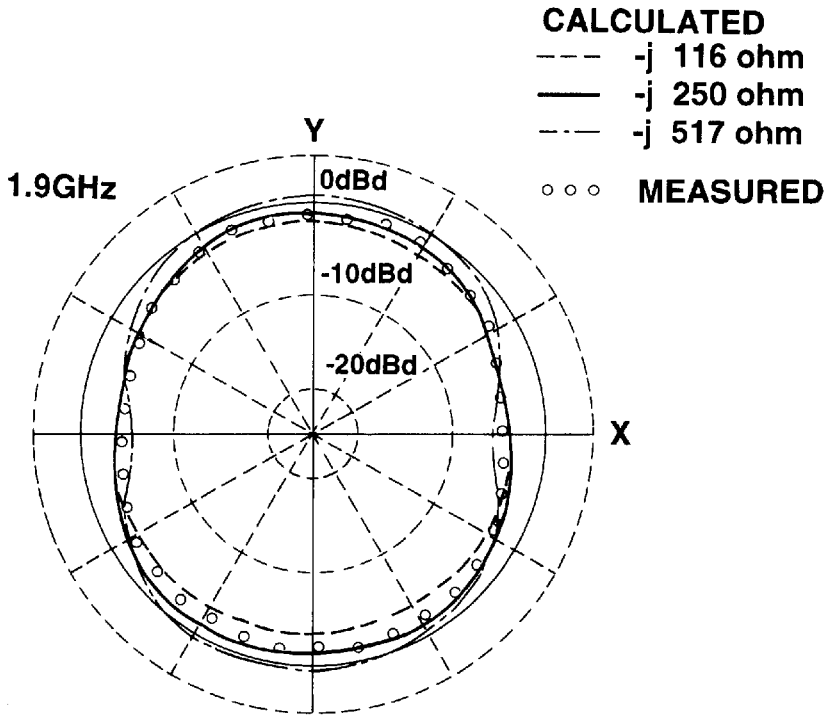
FIGS. 11A to 11C show radiation distribution characteristics in the experimental model of FIG. 9.
Figure 11B:
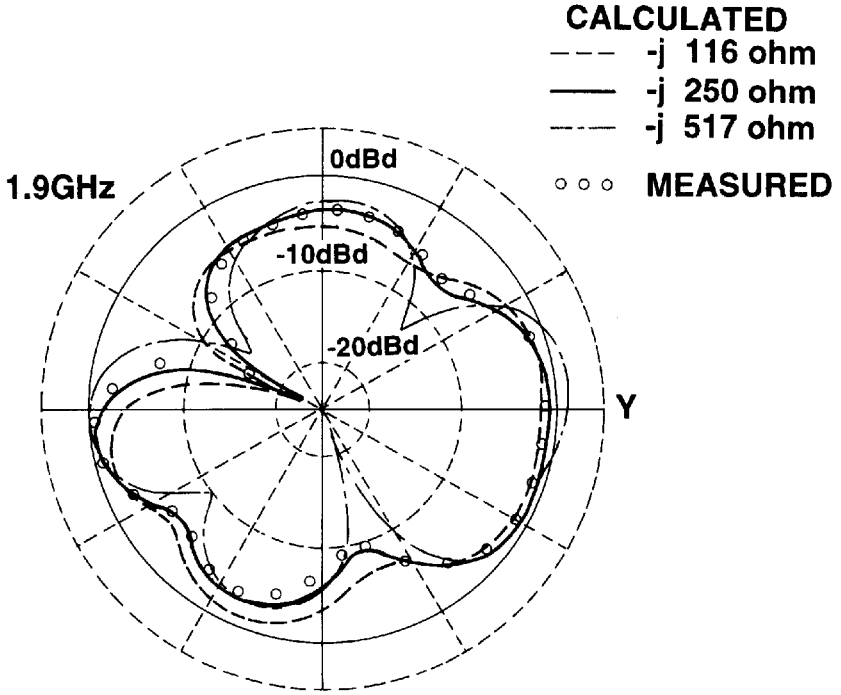
Figure 11C:
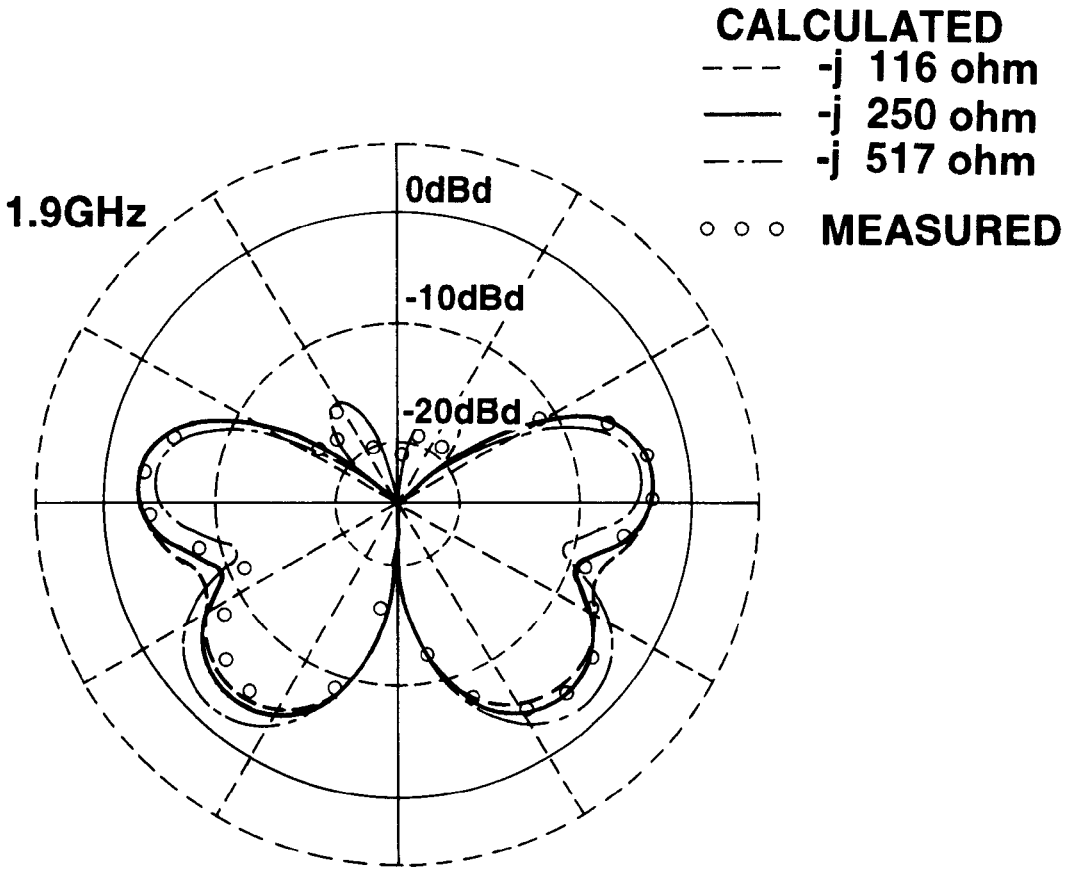

In FIGS. 11A, 11B and 11C, there are indicated antenna gain patterns in the X-Y plane, the Y-Z plane, and the Z-X plane, respectively. In these drawings, a broken line, a solid line, and a dot/dash line represent patterns of antenna gains calculated in this first simulation model under such a condition that the reactance $Z_L$ is selected to be −j116 ohms, −j250 ohms, and −j517 ohms, respectively. Symbol o indicates values actually measured under such a condition that the reactance $Z_L$ is selected to be −j250 ohms in the first simulation model.

As understood from these drawings FIGS. 11A to 11C, the gain of the antenna apparatus according to the present invention within the horizontal plane becomes very high. In particular, the gain on the Y axis is approximated to the ideal gain value of 0 [dBd]. Although not shown in these drawings, the calculation values and the actual measurement values with respect to the second simulation models were substantially identical to those of the first simulation model.

Figure 13A:
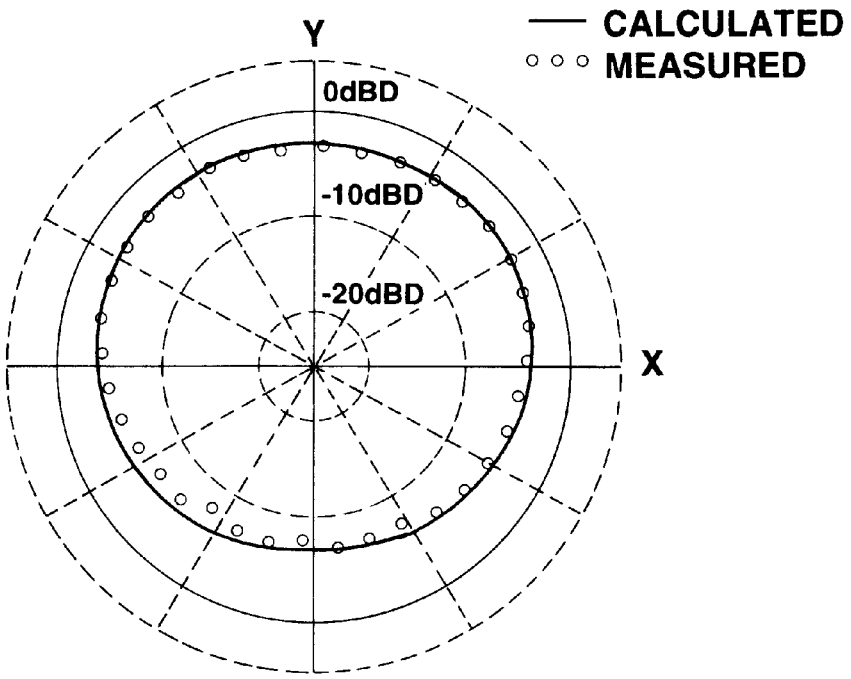
FIGS. 13A, 13B and 13C denote a radiation distribution characteristic in case that both the main and sub-housings are shortcircuited in the experimental model of FIG. 9.
Figure 13B:
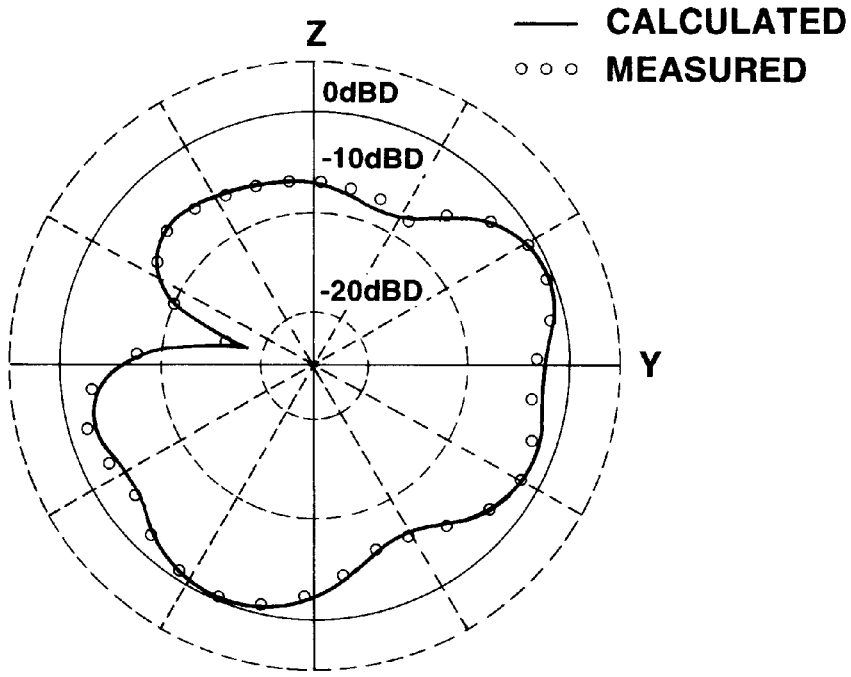
Figure 13C:
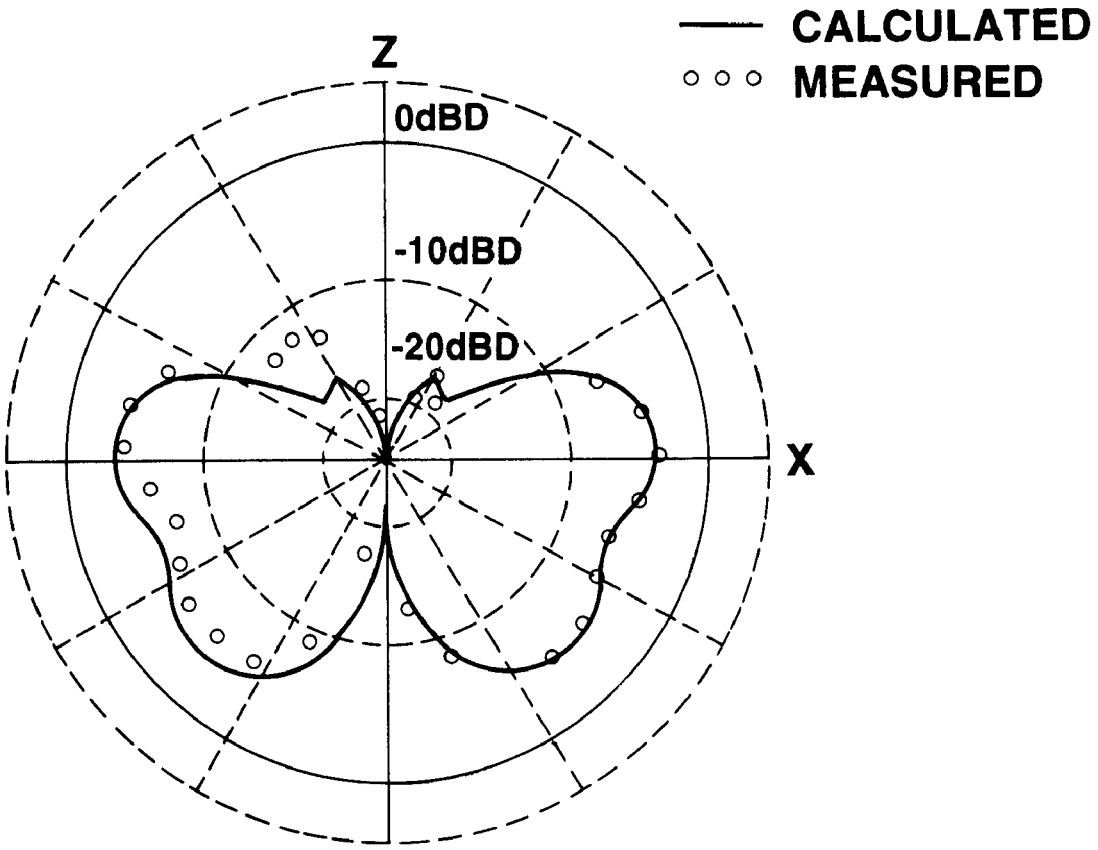

For the sake of reference purpose, antenna gain patterns within the X-Y plane, the Y-Z plane, and the Z-X plane when the first conductive member 30 is directly connected to the second conductive member 31 without the passive load 32, are represented in FIG. 13A to FIG. 13C. These antenna gain patterns are similar to those obtained under such a condition that the main metal housing 12 is shortcircuited to the sub-metal housing 13 via the circuit connecting line 15 in view of the RF currents within the antenna apparatus shown in FIG. 8. As apparent from the comparisons of the antenna gain pattern shown in FIGS. 11A to 11C and FIGS. 13A to 13C, the antenna apparatus of the present invention could have considerably high gain, i.e., better antenna characteristics.

The calculation results shown in FIG. 10 and FIG. 11 also represent that the antenna radiation patterns can be controlled by controlling the impedance of the passive load 32. In other words, these calculation results show that the averaged gain within the X-Y plane, and the gains on the respective axis can be varied by changing the impedance of the passive load 32.

Figure 12:
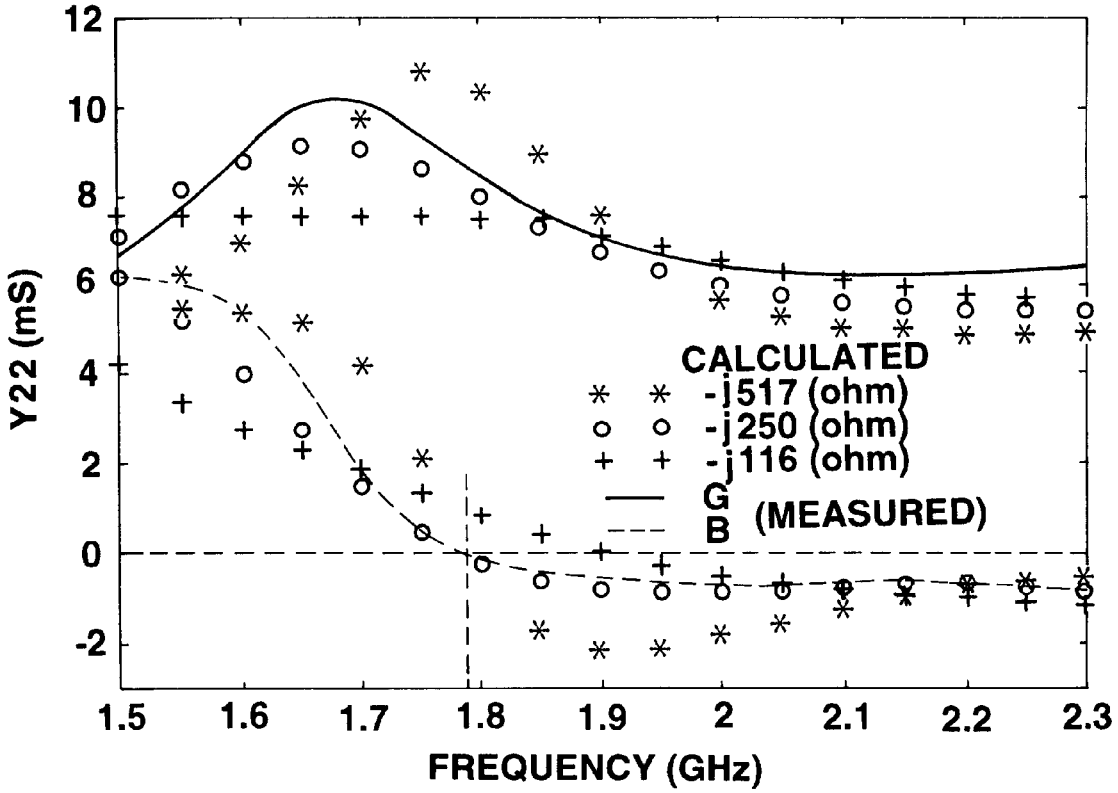
FIG. 12 shows a frequency/antenna input admittance characteristic in the experimental model of FIG. 9.

FIG. 12 represents an input admittance of the monopole antenna 11 when a frequency is varied. An abscissa of FIG. 12 indicates the frequency and an ordinate thereof shows the input admittance.

In this drawing, a solid line and a broken line represent a real part and an imaginary part of the input admittance when the reactance $Z_L$ is selected to be −j250 ohms, and is actually measured in the first simulation model. Also, symbols "+", "o", and "*" show calculation results obtained when the reactance $Z_L$ is selected to be −j116 ohms, −j250 ohms, and −j517 ohms, respectively, in this first simulation model.

As apparent from FIG. 12, a resonant frequency (namely, a frequency at which an imaginary part of an input admittance becomes 0) for the calculated value and the actually measured value when the reactance $Z_L$ is selected to be −j250 ohms, and also the calculated value when the reactance $Z_L$ is selected to be −j517 ohms, is 1.79 GHz. As a result, the resonant frequency in these cases becomes low by approximately 6% with respect to 1.9 GHz. This implies that the length of the monopole antenna 11 can be shortened by approximately 6%. Accordingly, the feature of the antenna apparatus according to the present invention may contribute that the length of the monopole antenna 11 is shortened.

Figure 14:
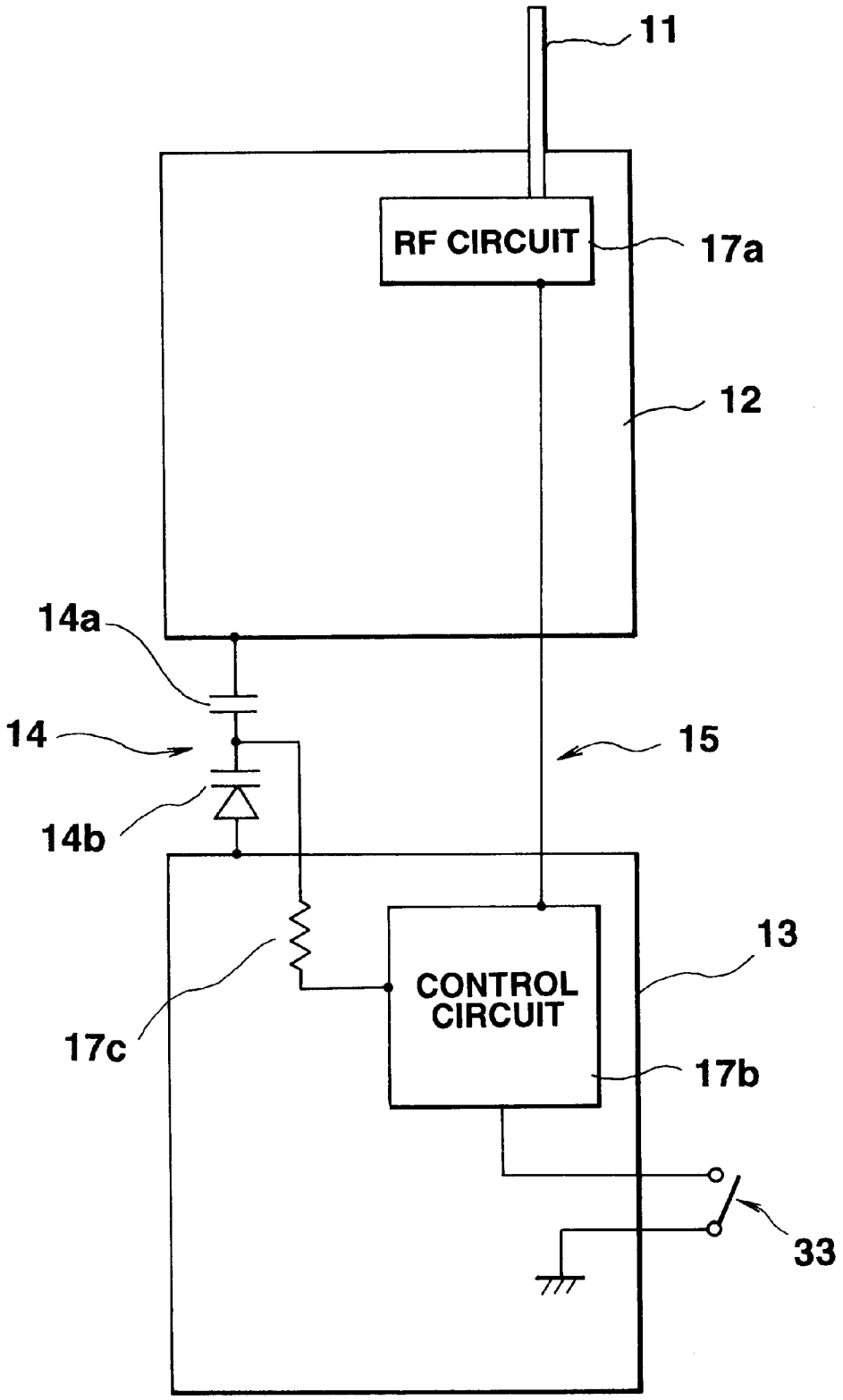
FIG. 14 schematically shows a structure of an antenna apparatus according to a third embodiment of the present invention.
Figure 15:
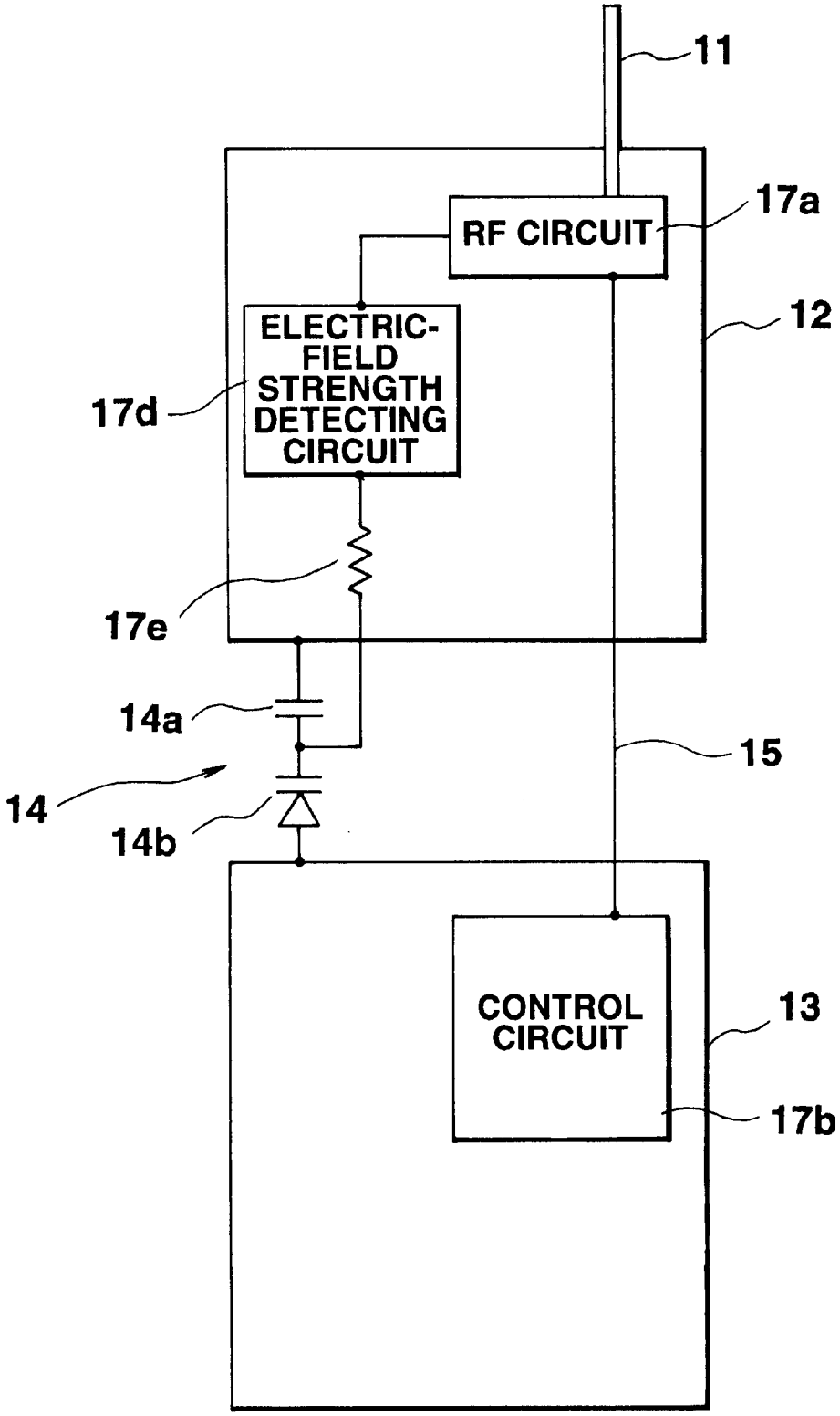
FIG. 15 schematically indicates a structure of an antenna apparatus according to a fourth embodiment of the present invention.

FIG. 14 and FIG. 15 schematically indicate antenna apparatuses according to a third embodiment and a fourth embodiment of the present invention. These third and fourth embodiments embody controls of antenna radiation patterns by adjusting the impedance of the passive load 32, which could be confirmed by the above-described simulation.

First, the antenna apparatus shown in FIG. 14 is constructed in such a manner that the control element 14 is arranged by a capacitor 14*a* and a variable-capacitance diode 14*b*, and the impedance of the control element 14 is controlled in accordance with operations of an external key 33 and conditions of received signals. An RF circuit 17*a* and the like are contained within the main metal housing 12, whereas a control circuit 17*b* and the like are included in the sub-metal housing 13. The control circuit 17*b* supplies a controlling voltage via a resistor 17*c* to a junction between the capacitor 14*a* and the variable-capacitance diode 14*b* based upon levels of the received signal entered from the RF circuit 17*a* via the circuit connecting line 15. As a result, a capacitance of this variable-capacitance diode 14*b*, namely the impedance of the control element 14 is varied, so that the antenna radiation pattern is varied. When the antenna radiation pattern is controlled by way of the external operation key 33, as shown in FIG. 14, the external operation key 33 is connected to the control circuit 17*b*. When the external operation key 33 is operated, the control circuit 17*b* furnishes a controlling voltage via the resistor 17*c* to the junction between the capacitor 14*a* and the variable-capacitance diode 14*b* based upon, for example, operation times of this operation key 33, thereby changing the impedance of the control element 14.

In the antenna apparatus of the fourth embodiment indicated in FIG. 15, an electric-field strength (intensity) detecting circuit 17*d* is provided within the main-metal housing 12, an electric-field strength of an electromagnetic wave received by the RF circuit 17*a* is detected by the electric-field strength detecting circuit 17*d*, a controlling voltage determined in response to this detected electric-field strength is applied via the resistor 17*e* to the junction point between the capacitor 14*a* and the variable-capacitance diode 14*b*, whereby the impedance of the control element 14 may be varied.

In FIGS. 16 to 19, there are illustrated such examples that the antenna apparatuses according to the present invention are actually mounted within main body cases of portable communication units.

Figure 16A:
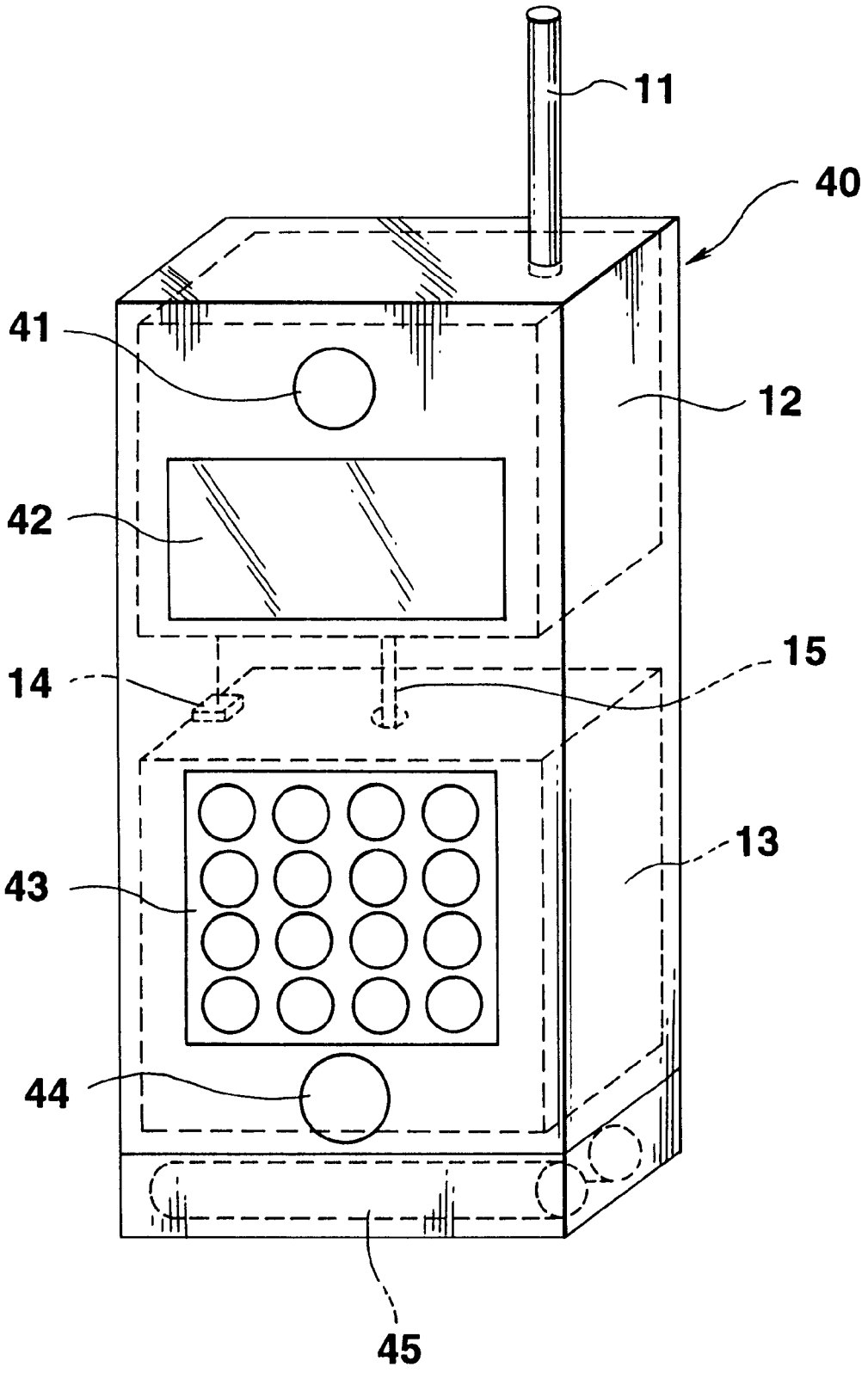
FIGS. 16A and 16B schematically show a mounting condition of the antenna apparatus according to the present invention, in a portable communication apparatus.
Figure 16B:
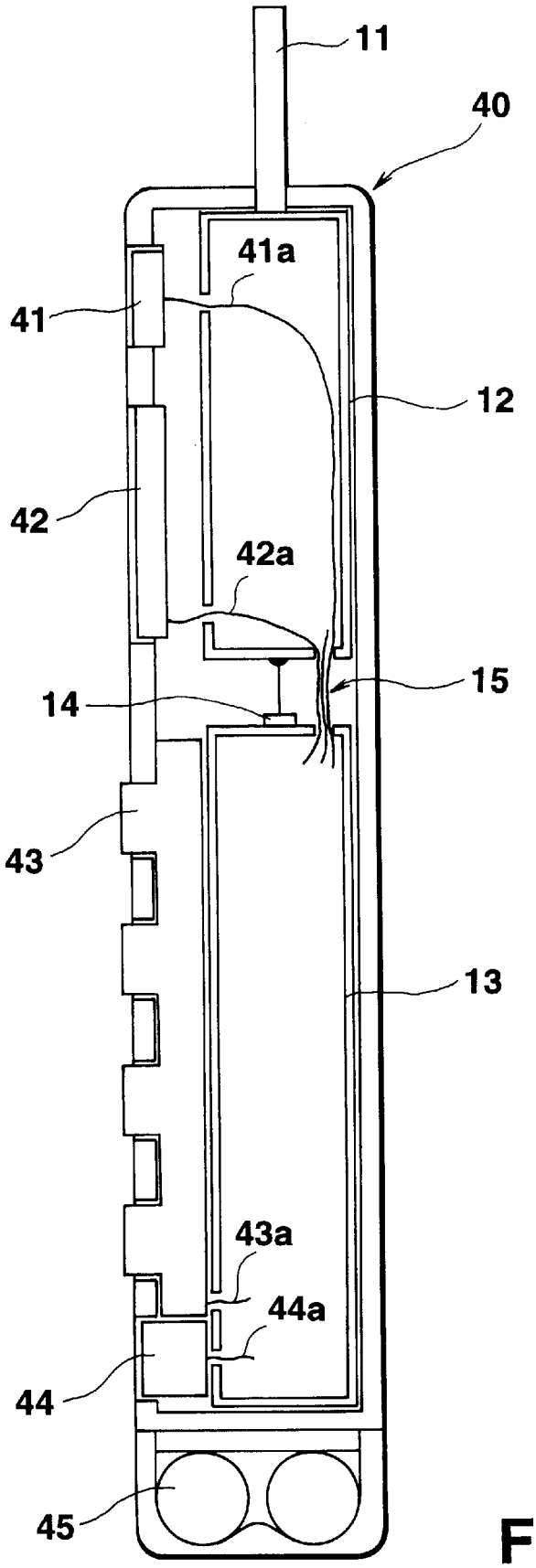

FIG. 16 shows a first actually mounted example. FIG. 16A is a perspective view of this first example where the internally provided antenna apparatus may be observed from outside of the main body case of the portable communication unit. FIG. 16B schematically shows an arranging condition of the major components employed within the main body case. The main metal housing 12 and the sub-metal housing 13 of the antenna apparatus are fixed to the arrangements as shown in the main body case 40 made of a resin. Within the main body case 40, there are provided a speaker 41 for producing sounds, a display device 42 such as an LCD (liquid crystal display) for displaying various data, a keyboard 43 for entering the various data, and a microphone 44 for acoustically receiving a sound signal of a speaker. Since the mounting positions of the speaker 41 and the display device 42 are located in an upper half portion of the main body case 40 corresponding to the storage position of the main metal housing 12 for including the RF circuit and the like, a signal line 41*a* of the speaker 41 and a signal line 42*a* of the display device 42 are once drawn, or extracted into the main metal housing 12. Then, these signal lines 41*a* and 42*a* are connected to the control circuit employed in the sub-metal housing 13 as one of the circuit connecting lines 15. On the other hand, since the mounting positions of the keyboard 43 and the microphone 44 are located in a lower half portion of the main body case 40 corresponding to the storage position of the sub-metal housing 13, a signal line 43*a* of the keyboard 43 and a signal line 44*a* of the microphone 44 are directly drawn into the sub-metal housing 13 and then are connected to the control circuit employed within this sub-metal housing 13. It should be noted that since the signal line 42*a* of the display device 42 is practically constructed of a large number of signal lines, for instance, a display drive circuit and the like may be provided within the main metal housing 12 so as to reduce the total number of circuit connecting liens 15. Reference numeral 45 shows a cell for supplying power to the respective circuits.

Figure 17:
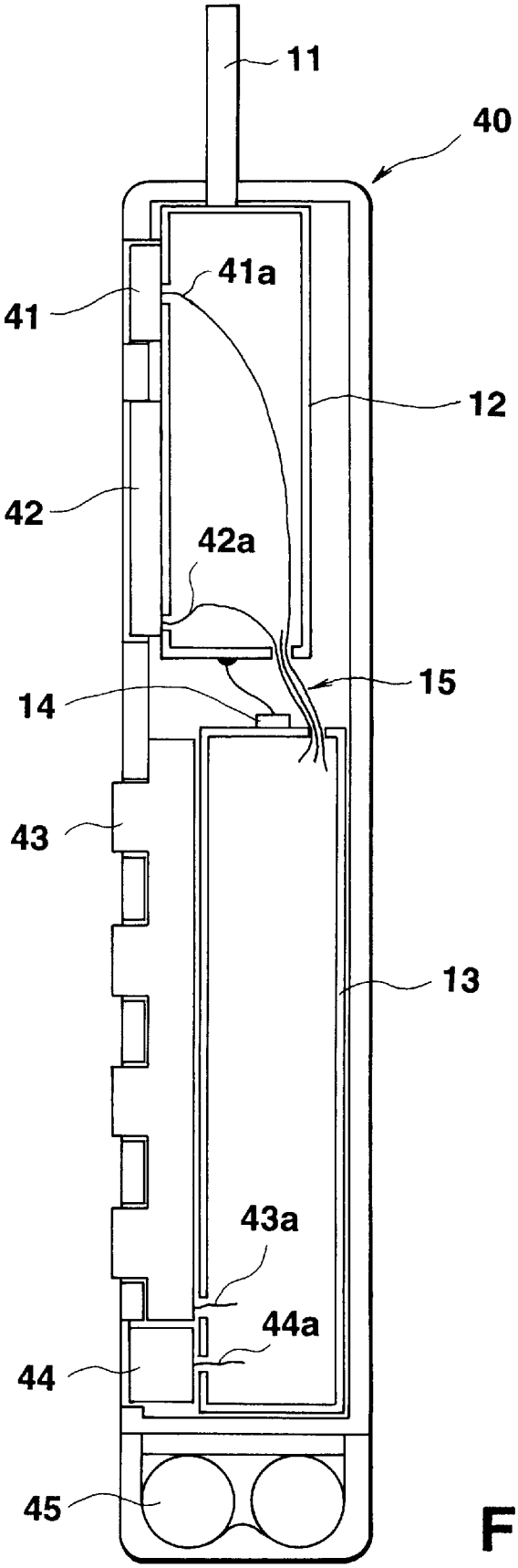
FIG. 17 schematically shows another mounting condition of the antenna apparatus according to the present embodiment, in the portable communication apparatus.

FIG. 17 schematically indicates a second actually mounted example. There is only such a difference between the second actually mounted example and the first actually mounted example as follows: That is, the main metal housing 12 of the antenna apparatus is positionally shifted toward the side of the speaker 41, namely toward the front side of the main body case 40. This second actually mounted structure becomes effective in such a case that the front-to-rear ratio of the antenna radiation pattern is varied. This front-to-rear ratio implies a ratio of an antenna gain on the front side of the main body case 40 to an antenna gain on the rear side thereof. In other words, it is a useful actually mounted structure in case that the antenna gain on the rear side of the main body case 40 located opposite to the operator side during the communication operation.

When the main metal housing 12 is installed in the vicinity of the speaker 41 and display device 42, the main metal housing 12 may be formed to directly receive the speaker 41 and display device 42. As well, the sub-metal housing 13 may be formed to directly receive the keyboard 43 and the microphone 44. As a result, the assembling operation of parts into the main body case 40 can be simplified.

Figure 18:
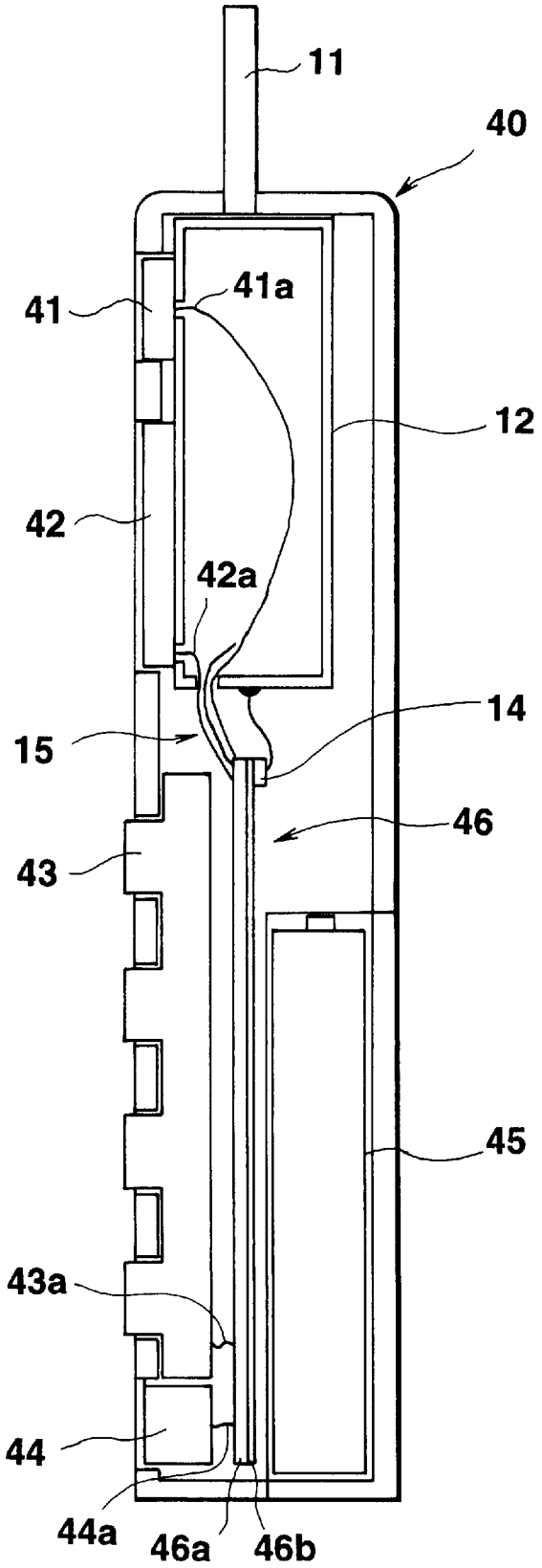
FIG. 18 schematically represents a further mounting condition of the antenna apparatus according to the present invention, in the portable communication apparatus.

FIG. 18 schematically indicates another actually mounted example of the antenna apparatus having no sub-metal housing 13. In FIG. 18, reference numeral 46 denotes a circuit board on which a control circuit and the like are mounted. This circuit board 46 is constructed of a laminated board 46*a* whose conductive layers are multilayer. The grounding conducive layer may be formed by arbitrary layers. In this example, the conductive layer 46*b* at the rear surface is utilized as the grounding conductive layer. Then, the main metal housing 12 including the RF circuit unit is connected via the control element 14 and the grounding conductive layer 46*b* formed on the rear surface of the circuit board 46. Also, the signal line 41*a* of the speaker 41 and the signal line 42*a* of the display device 42 are connected to relevant terminals formed on the circuit board 46 as one of the circuit connecting lines 15, whereas the signal line 43*a* of the keyboard 43 and the signal line 44*a* of the microphone 44 are directly connected to the corresponding terminals formed on the circuit board 46. As one modification, in case that the RF circuit unit is similarly not stored within the main metal housing 12, a grounding conductive layer of the circuit board on which this RF circuit unit is mounted is connected via the control element 14 with the grounding conductive layer 46*b* of the circuit board 46, and the circuit connecting line 15 for connecting both of these circuit units is arranged by an optical fiber. That is, these circuit units may be connected with each other by way of the connecting structure as illustrated in FIG. 7.

Figure 19:
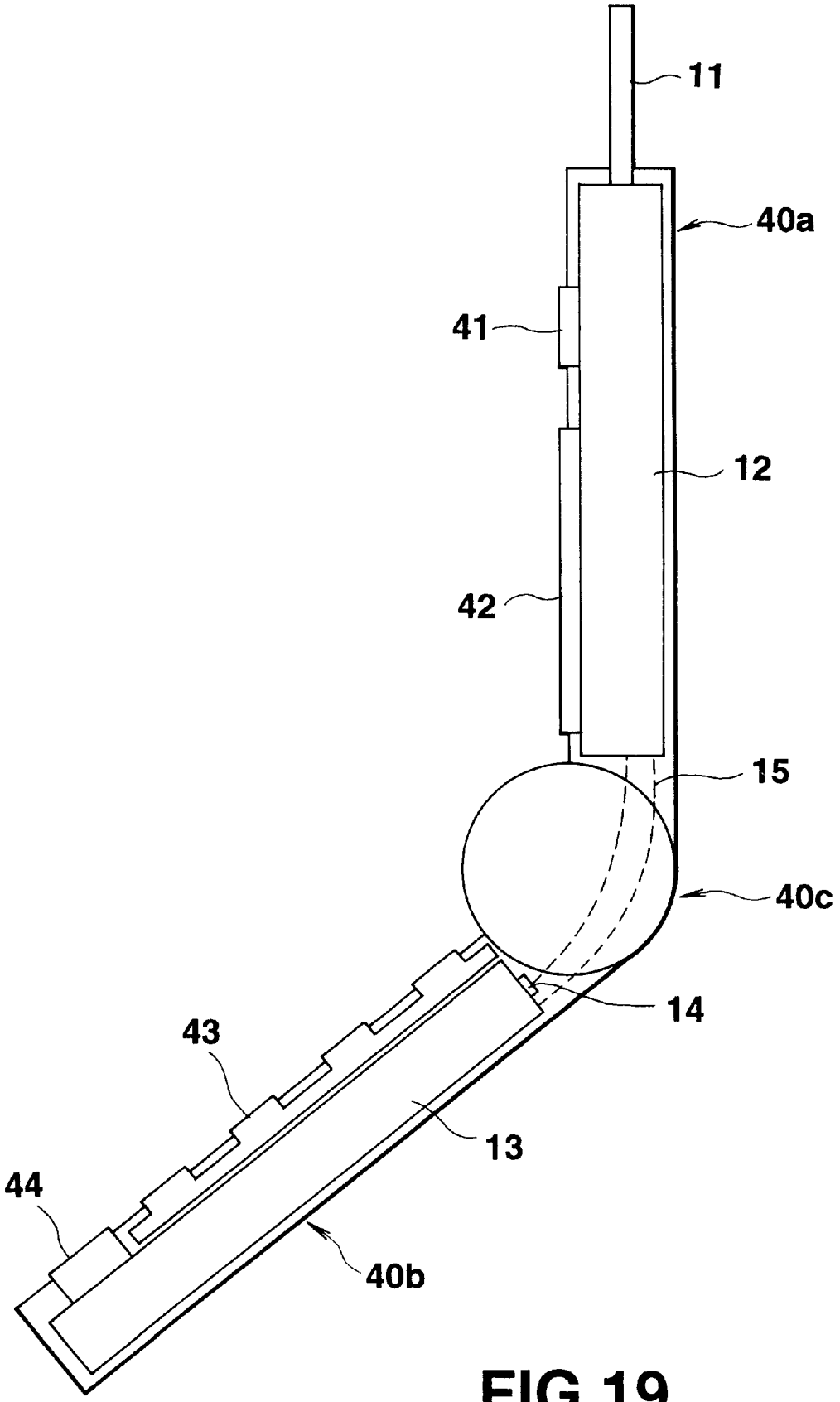
FIG. 19 schematically indicates a still further mounting condition of the antenna apparatus according to the present invention, in the portable communication apparatus.

FIG. 19 schematically shows another actually mounted example in which the antenna apparatus according to the present invention is installed into a folded type appliance case. As shown in FIG. 19, a main body case of this appliance is constructed of a first case portion 40*a* and a second case portion 40*b*, and these first and second case portions 40*a* and 40*b* are mechanically connected with each other by using a hinge portion 40*c*, whereby a folded type appliance case is formed. The main metal housing 12 of the antenna apparatus is stored into the first case portion 40*a*, whereas the sub-metal housing 13 is stored into the second case portion 40*b*. The antenna apparatus according to the present invention can be simply mounted even in the above-described folded type appliance case by merely employing flexible connecting lines as the circuit connecting line 15 for connecting the main metal housing 12 to the sub-metal housing 13, and the connecting line for connecting the control element 1 to either the main metal housing 12, or the sub-metal housing 13.

As apparent from the actually mounted examples shown in FIG. 16, FIG. 17 and FIG. 19, the antenna apparatus according to the present invention could be mounted in the various modes without modifying the shapes of the main and sub-metal housings 12 and 13 for storing the circuit portions. Also, even if the circuit portions are not stored into these metal housings, as illustrated in FIG. 18, these circuit portions may be mounted in a similar manner to that of the two metal housings.

It should be understood that although the antenna apparatuses of the above-described embodiments have been applied to the monopole antenna, the present invention is not limited to this monopole antenna, but may be applied to many other types of antenna such as a microstrip antenna and a reverse F type antenna.

Figure 20:
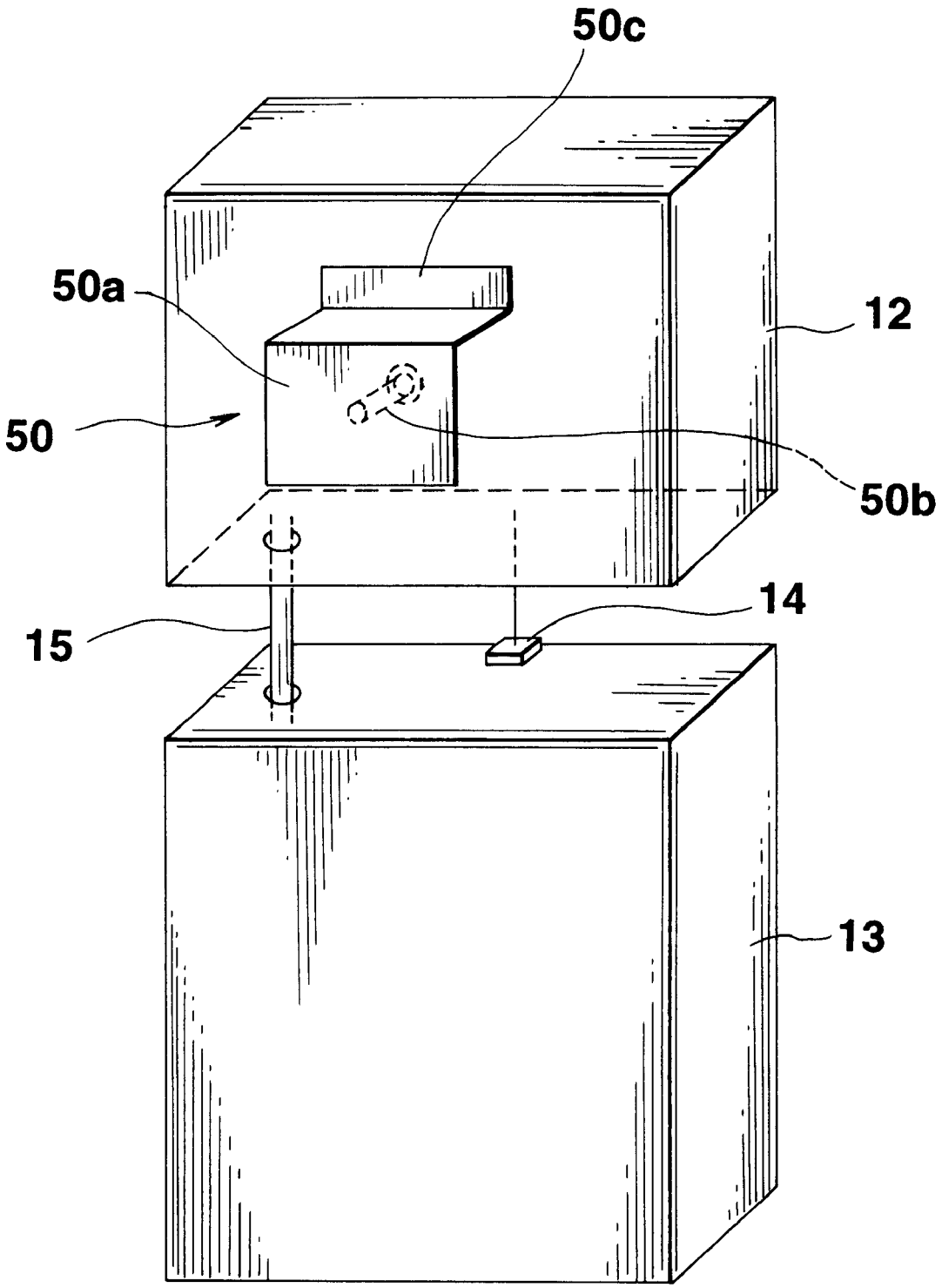
FIG. 20 schematically shows a structure of an antenna apparatus according to a fifth embodiment of the present invention.

FIG. 20 schematically shows a structural example of a microstrip antenna. Reference numeral 50 indicates a plate-shaped microstrip antenna. The microstrip antenna 50 of this embodiment is formed in such a manner that one edge portion of a rectangular metal plate is folded to have a crank shaped section thereof. A major portion of this rectangular metal plate functions as a radiation element portion 50*a*, and the folded edge portion of this metal plate functions as a shortcircuit terminal portion 50*c*. The shortcircuit terminal portion 50*c* is fixed to the main metal housing 12. Power is supplied via a power feeding terminal 50*b* to a center of the radiation element unit 50*a* of this microstrip antenna 50. Not only the vertical length of the radiation element 50*a* of the microstrip antenna 50, but also the horizontal length thereof may be preferably made of ½λ.

The setting position of the microstrip antenna 50 may be preferably set to such a position that the central position of the radiation element unit 50*a* is located on the central line of the main metal housing 12. The optimum setting position of this microstrip antenna 50 is a substantially center portion of the major surface of the main metal housing 12, as illustrated in FIG. 20. A desirable position for connecting the main metal housing 12 with the sub-metal housing 13 via the control element 14, corresponds to a substantially central portion on a surface opposite to the surface where the microstrip antenna 50 is set. A setting position of the circuit connecting line 15 for connecting the circuit stored in the main metal housing 12 to the circuit employed in the sub-metal housing 13 may be arbitrarily determined.

When this antenna apparatus is stored into the main body of the portable communication unit, for example, the case 40 shown in FIG. 16, the surface on which the microstrip antenna 50 is mounted corresponds to the rear surface of the case 40 (namely, the surface where the speaker 41 and the display device 42 are not provided).

Figure 21:
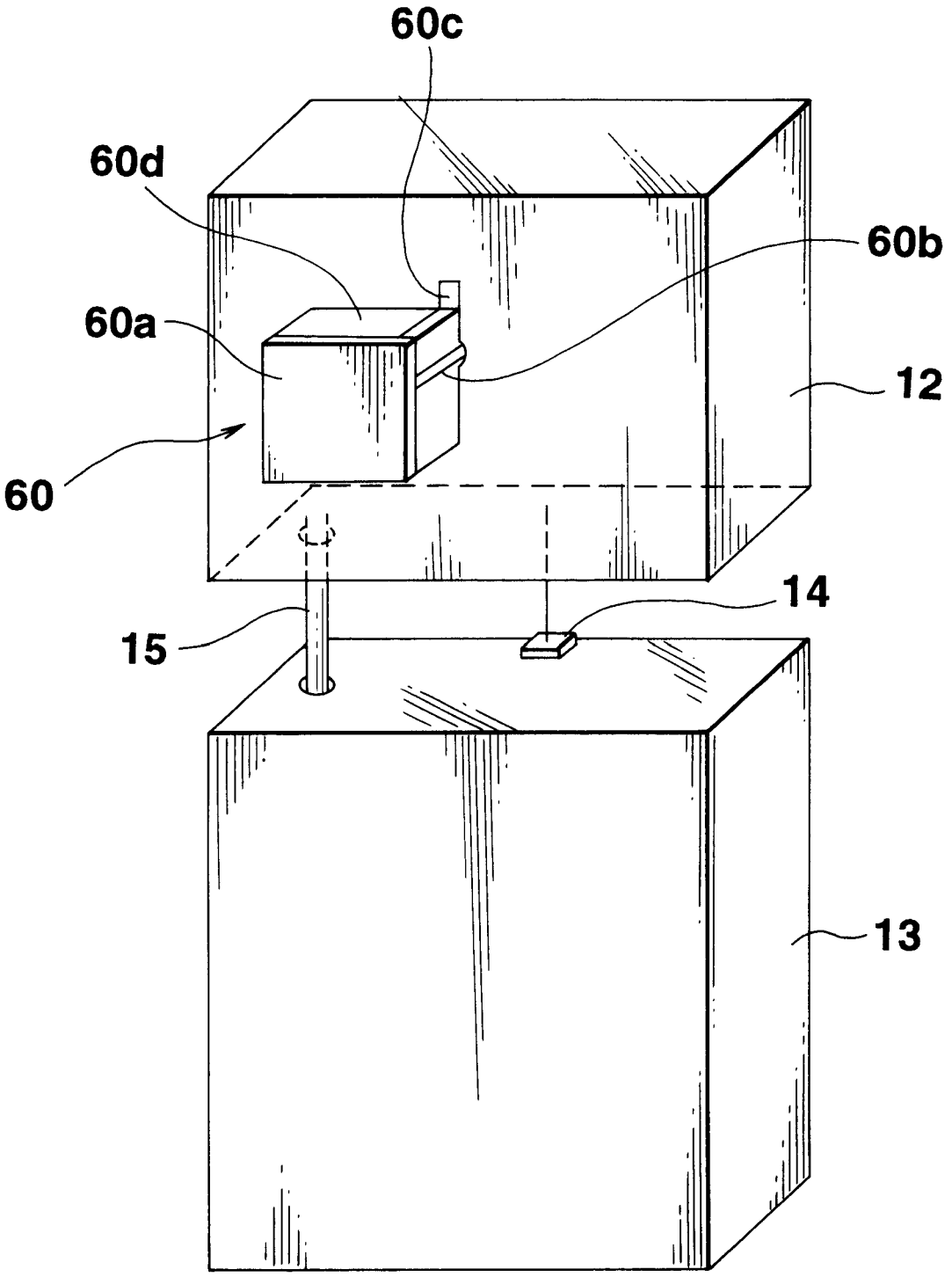
FIG. 21 schematically shows a structure of an antenna apparatus according to a sixth embodiment of the present invention.

FIG. 21 schematically illustrates a structural example of a reverse F type antenna. In this drawing, reference numeral 60 shows a plate-shaped reverse F type antenna. The plate-shaped reverse F type antenna 60 according to this embodiment is so arranged that a radiation element 60*a* is formed on a dielectric plate 60*d*, and this dielectric plate 60*d* is adhersively connected to the surface of the main metal housing 12. The radiation element 60*a* is shortcircuited to the main metal housing 12 via a shortcircuit terminal 60*c* extending to the surface of the main metal housing 12 through the upper right end portion of the dielectric plate 60*d* from the upper right corner. Power is supplied to the radiation element 60*a* via a power feeding terminal 60*b* provided on the right side surface of the dielectric plate 60*d*. Both the vertical length and the horizontal length of the radiation element 60*a* are selected to be ¼λ, respectively.

Preferably, the setting position of the reverse F type antenna is located at such a position on a line to connect the power supply terminal 60*b* with the shortcircuit terminal 60*c*, namely a position where the right side surface of the dielectric plate 60*d* is present on the central line of the main metal housing 12. The optimum setting position of this reverse F type antenna is such a position, as shown in FIG. 21, that the right side surface of the dielectric plate 60*d* is located substantially at the center of the major surface of the main metal housing 12. Both the position for connecting the main metal housing 12 via the control element 14 to the sub-metal housing 13, and also the setting position of the circuit connecting line 15 are similar to those of the above-described microstrip antenna 50. The direction of the antenna apparatus when this antenna apparatus is stored into the main body case of the portable communication unit, is set in a similar manner to that of the microstrip antenna 50.

Figure 22:
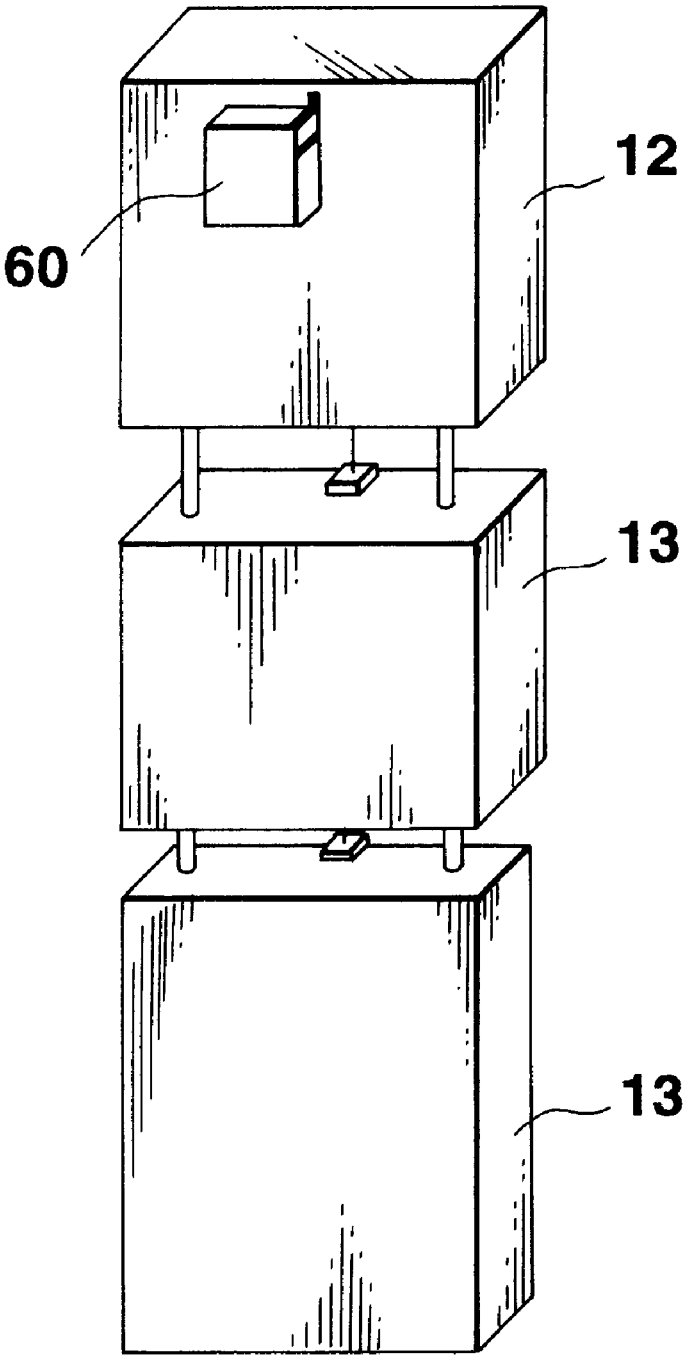
FIG. 22 schematically shows a structure of an antenna apparatus according to a seventh embodiment of the present invention.

Although the number of conductive members such as the metal housings is selected to be two in the above-explained embodiments, the present invention is not limited to such a case where the quantity of conductive members is two. For example, as shown in FIG. 22, two sub-metal housings 13 and 13 may be equipped with the main metal housing 12 on which an antenna 60 is mounted. In this case, there are provided the control element 14 for mutually connecting these metal housings, and also the circuit connecting line 15 for mutually connecting the circuits employed in these metal housings between the main metal housing 12 and the sub-metal housing 13, and also between the first sub-metal housing 13 and the second sub-metal housing 13, respectively.

What is claimed is:

1. An antenna apparatus comprising:

a first conductor;

an antenna mounted on said first conductor;

a second conductor;

an element having an impedance characteristic which is variable in response to a voltage applied thereto and being electrically connected between said first conductor and said second conductor with respect to a high frequency; and a control voltage supply means for supplying a control voltage to said element so as to control the impedance of said element such that said element allows a predetermined amount of a high frequency current induced by at least one of a transmission and a reception radio signal from said antenna to flow through said first and second conductors so as to obtain a predetermined current distribution pattern of the high frequency current for improving radiation characteristics of said antenna.

2. An antenna apparatus as claimed in claim 1, further comprising a manual operation knob for controlling said control voltage supply means, and wherein said control voltage supply means supplies a control voltage based upon operation of said manual operation knob.

3. An antenna apparatus as claimed in claim 1, wherein said control voltage supply means comprises means for outputting a control voltage based on a strength of a signal received by said antenna.

4. An antenna apparatus as claimed in claim 1, wherein:

said first conductor comprises a conductive housing for storing therein at least one of a transmitting circuit and a receiving circuit, and said antenna is a ¼λ monopole antenna which is mounted on an upper surface of said conductive housing, wherein "λ" is a wavelength of an electromagnetic wave received by said ¼λ monopole antenna.

5. An antenna apparatus as claimed in claim 1, wherein:

said first conductor comprises a conductive housing for storing therein at least one of a transmitting circuit and a receiving circuit, and said antenna comprises a plane antenna which is mounted on a rear surface of said conductive housing.

6. An antenna apparatus as claimed in claim 1, wherein:

said first and second conductors comprise first and second conductive housings, respectively, each for storing therein a circuit unit, and said antenna apparatus further comprises a speaker provided on said first conductive housing, and a microphone provided on said second conductive housing.

7. An antenna apparatus as claimed in claim 1, wherein:

said first and second conductors comprise first and second conductive housings, respectively, each for storing a circuit unit, and said first conductive housing is positionally shifted from said second conductive housing along a front-to-rear direction.

8. An antenna apparatus as claimed in claim 1, wherein said element is constructed as a capacitor.

9. An antenna apparatus comprising:

a first conductor;

an antenna mounted on said first conductor;

a second conductor; and an element having only a substantially reactive circuit component and being electrically connected between said first conductor and said second conductor with respect to a high frequency, for allowing a predetermined amount of a high frequency current induced by at least one of a transmission and a reception radio signal from said antenna to flow through said first and second conductors so as to obtain a predetermined current distribution pattern of the induced high frequency current for improving radiation characteristics of said antenna.

10. An antenna apparatus as claimed in claim 9, wherein said reactance component of said element is variable with a voltage applied thereto, and said antenna apparatus further comprising controlling voltage outputting means for outputting a control voltage to said element so as to control the reactance of said element.

11. An antenna apparatus as claimed in claim 10, further comprising a manual operation knob for controlling said controlling voltage outputting means, and wherein said controlling voltage outputting means outputs a controlling voltage based upon operation of said manual operation knob.

12. An antenna apparatus as claimed in claim 10, wherein said controlling voltage outputting means outputs a controlling voltage based on a strength of a signal received by said antenna.

13. An antenna apparatus as claimed in claim 9, further comprising:

a speaker mounted on said first conductor; and a microphone mounted on said second conductor.

14. An antenna apparatus as claimed in claim 9, wherein said first conductor and said second conductor are disposed on different imaginary planes.

15. An antenna apparatus including a high frequency circuit unit and a low frequency circuit unit, said antenna apparatus comprising:

a first conductive housing for containing the high frequency circuit unit;

an antenna mounted on said first conductive housing;

a second conductive housing for containing the low frequency circuit unit; and an element having only a substantially reactive circuit component and being electrically connected between said first conductive housing and said second conductive housing with respect to a high frequency, for allowing a predetermined amount of a high frequency current induced by at least one of a transmission and a reception radio signal from said antenna to flow through said first and second conductive housings so as to obtain a predetermined current distribution pattern of the induced high frequency current for improving radiation characteristics of said antenna.

16. An antenna apparatus as claimed in claim 15, wherein said antenna is a ¼λ monopole antenna mounted on an upper surface of said first conductive housing.

17. An antenna apparatus claimed in claim 15, wherein said antenna comprises a plane antenna mounted on a rear surface of said first conductive housing.

18. An antenna apparatus as claimed in claim 15, wherein:

said first conductive housing has an opening, for containing the high frequency circuit unit;

said second conductive housing has an opening, for containing the low frequency circuit unit; and said antenna apparatus further comprising:

a circuit connecting line extending into said first and second conductive housings through said openings therein to connect said high frequency and low frequency circuit units to each other, said circuit connecting line being arranged so as not to make a high frequency connection between said first and second conductive housings.

19. An antenna apparatus as claimed in claim 18, further comprising a ¼ wave length open stub which is connected to said circuit connecting line such that said stub has one end which is connected to said circuit connecting line, and another end which is open in a vicinity of the respective opening.

20. An antenna apparatus a claimed in claim 18, further comprising a conductive sleeve connected to an opening of the conductive housings, and wherein said circuit connecting line comprises a co-axial cable, one end of which is inserted into said sleeve, and an external conductor of which is connected to said sleeve.

21. An antenna apparatus as claimed in claim 18, wherein said circuit connecting line comprises an optical fiber.

22. A portable radio communication apparatus including a transmitter circuit, a receiver circuit, a control circuit, and a resin housing, the apparatus comprising:

a first conductive housing contained in the resin housing, for containing at least one of the transmitter circuit and the receiver circuit;

an antenna mounted on said first conductive housing;

a second conductive housing contained in the resin housing, for containing the control circuit; and an element having only a substantially reactive circuit component and being electrically connected between said first and second conductive housings with respect to a high frequency, for allowing a predetermined amount of a high frequency current induced by at least one of a transmission and a reception radio signal from said antenna to flow through said first and second conductive housings so as to obtain a predetermined current distribution pattern of the induced high frequency current for improving radiation characteristics of said antenna.

23. A portable radio communication apparatus as claimed in claim 22, further comprising:

a speaker mounted on a surface of said resin housing where said first conductive housing is held; and a microphone provided on said resin housing where said second conductive housing is held.

24. A portable radio communication apparatus as claimed in claim 23, wherein:

said antenna comprises a plane antenna, and said plane antenna is mounted on a surface of said resin housing, which surface of said resin housing is opposite to the surface of said resin housing where the speaker is mounted.

25. A portable radio communication apparatus as claimed in claim 22, wherein:

said first conductive housing is held on a forward side of said second conductive housing within said resin housing.

26. A radio communication apparatus including a high frequency circuit unit, a low frequency circuit unit, a first resin housing, a second resin housing, the first resin housing and the second resin housing being mechanically and foldably connected to each other so as to be in one of an open state and a closed state, the apparatus comprising:

a first conductive housing contained in the first resin housing, for containing the high frequency circuit unit;

an antenna mounted on said first conductive housing;

a second conductive housing contained in the second resin housing, for containing the low frequency circuit unit; and an element having only a substantially reactive circuit component and being electrically connected between said first and second conductive housings with respect to a high frequency, for allowing a predetermined amount of a high frequency current induced by at least one of a transmission and a reception radio signal from said antenna to flow through said first and second conductive housings so as to obtain a predetermined current distribution pattern of the induced high frequency current for improving radiation characteristics of said antenna.

27. A portable radio communication apparatus as claimed in claim 26, further comprising:

a speaker mounted on said first resin housing; and a microphone mounted on said second resin housing.

28. An antenna apparatus including an antenna and first and second circuit units, the antenna apparatus comprising:

a first conductive housing having a first opening, for containing the first circuit unit;

an antenna mounted on said first conductive housing and connected to the first circuit unit contained in said first conductive housing;

a second conductive housing having a second opening, for containing the second circuit unit;

an element having an impedance characteristic which is variable in response to a voltage applied thereto and being electrically connected between said first and second conductive housings with respect to a high frequency;

a control voltage supply means for supplying a control voltage to said element so as to control the impedance of said element such that said element allows a predetermined amount of a high frequency current induced by at least one of a transmission and a reception radio signal from said antenna to flow through said first and second conductive housings so as to obtain a predetermined current distribution pattern of the induced high frequency current; and a circuit connecting line extending into said first and second conductive housings through said first and second openings therein to connect the first and second circuit units to each other, said circuit connecting line being arranged so as not to make a high frequency coupling between said first and second conductive housings for improving radiation characteristics of said antenna.

29. An antenna apparatus as claimed in claim 28, wherein a ¼λ open stub is provided within said first and second conductive housings, one end of which is connected to said circuit connecting line, and another end of which is opened near said opening of the respective conductive housing.

30. An antenna apparatus as claimed in claim 28, further comprising a conductive sleeve connected to the opening of the first conductive housing, and wherein said circuit connecting line comprises a co-axial cable, one end of which is inserted into said sleeve, and an external conductor of which is connected to said sleeve.

31. An antenna apparatus as claimed in claim 28, wherein said circuit connecting line comprises an optical fiber.

32. An antenna apparatus as claimed in claim 28, wherein said element has an impedance which is varied in response to an applied voltage thereto, and said antenna apparatus further comprises a controlling voltage outputting means for outputting a controlling voltage to said element so as to control the impedance of said element.

33. An antenna apparatus as claimed in claim 28, further comprising a manual operation knob for controlling said control voltage supply means, and wherein said control voltage supply means supplies a control voltage based upon operation of said manual operation knob.

34. A portable radio communication apparatus including a transmitter circuit, a receiver circuit, a control circuit, and a resin housing, the apparatus comprising:

a first conductive housing contained in the resin housing, for containing at least one of the transmitter circuit and the receiver circuit;

an antenna mounted on said first conductive housing;

a second conductive housing contained in the resin housing, for containing the control circuit;

an element having an impedance characteristic which is variable in response to a voltage applied thereto and being electrically connected between said first and second conductive housings with respect to a high frequency; and a control voltage supply means for supplying a control voltage to said element so as to control the impedance of said element such that said element allows a predetermined amount of a high frequency current induced by at least one of a transmission and a reception radio signal from said antenna to flow through said first and second conductive housings so as to obtain a predetermined current distribution pattern of the induced high frequency current for improving radiation characteristics of said antenna.

35. A portable radio communication apparatus as claimed in claim 34, further comprising:

a speaker provided on said resin housing at a position corresponding to said first conductive housing contained within said resin housing; and a microphone provided on said resin housing at a position corresponding to said second conductive housing contained within said resin housing.

36. A portable radio communication apparatus as claimed in claim 31, wherein said first conductive housing is positionally shifted to said second conductive housing along a front-to-rear direction within said resin housing.

37. A portable radio communication apparatus as claimed in claim 36, further comprising:

a speaker provided within said first conductive housing, and a microphone provided within said second conductive housing.

38. A portable radio communication apparatus as claimed in claim 34, wherein:

said antenna comprises a plane antenna, and said plane antenna is mounted on a surface of said first conductive housing located opposite to another surface of said first conductive housing where the speaker is mounted.

39. An antenna apparatus as claimed in claim 34, wherein said element has an impedance which is varied in response to an applied voltage thereto, and said antenna apparatus further comprises a controlling voltage outputting means for outputting a controlling voltage to said element so as to control the impedance of said element.

40. An antenna apparatus as claimed in claim 34, further comprising a manual operation knob for controlling said control voltage supply means, and wherein said control voltage supply means supplies a control voltage based upon operation of said manual operation knob.

41. A portable radio communication apparatus including a high frequency circuit unit, a low frequency circuit unit, a first resin housing, a second resin housing, the first resin housing and the second resin housing being mechanically and foldably connected to each other so as to be in one of an open state and a closed state, the apparatus comprising:

a first conductive housing contained in the first resin housing, for containing the high frequency circuit unit;

an antenna mounted on said first conductive housing;

a second conductive housing contained in the second resin housing, for containing the low frequency circuit unit;

an element having an impedance characteristic which is variable in response to a voltage applied thereto and being electrically connected between said first and second conductive housings with respect to a high frequency; and a control voltage supply means for supplying a control voltage to said element so as to control the impedance of said element such that said element allows a predetermined amount of a high frequency current induced by at least one of a transmission and a reception radio signal from said antenna to flow through said first and second conductive housings so as to obtain a predetermined current distribution pattern of the induced high frequency current for improving radiation characteristics of said antenna.

42. An antenna apparatus as claimed in claim 41, wherein said element has an impedance which is varied in response to an applied voltage thereto, and said antenna apparatus further comprises a controlling voltage outputting means for outputting a controlling voltage to said element so as to control the impedance of said element.

43. An antenna apparatus as claimed in claim 41, further comprising a manual operation knob for controlling said control voltage supply means, and wherein said control voltage supply means supplies a control voltage based upon operation of said manual operation knob.

44. A portable radio communication apparatus as claimed in claims 41, further comprising:

a speaker mounted on said first resin housing; and a microphone mounted on said second resin housing.

45. An antenna apparatus comprising:

a first conductor;

an antenna mounted on said first conductor;

a second conductor; and a capacitor electrically and directly connected between said first conductor and said second conductor with respect to a high frequency, for allowing a predetermined amount of a high frequency current induced by at least one of a transmission and a reception radio signal from said antenna to flow through said first and second conductors so as to obtain a predetermined current distribution pattern of the induced high frequency current for improving radiation characteristics of said antenna.

46. An antenna apparatus as claimed in claim 45, wherein the capacitance of said capacitor is variable with a voltage applied thereto, and said antenna apparatus further comprises a controlling voltage outputting means for outputting a control voltage to said capacitor so as to control the capacitance of said capacitor.

47. An antenna apparatus as claimed in claim 46, further comprising a manual operation knob for controlling said controlling voltage outputting means, and wherein said controlling voltage outputting means outputs a controlling voltage in response to operation of said manual operation knob.

48. An antenna apparatus as claimed in claim 46, wherein said controlling voltage outputting means outputs a controlling voltage in response to a magnitude of a signal received by said antenna.

49. An antenna apparatus as claimed in claim 45, further comprising:

a speaker mounted on said first conductor; and a microphone mounted on said second conductor.

50. An antenna apparatus as claimed in claim 45, wherein said first conductor and said second conductor are disposed in different imaginary planes.

51. An antenna apparatus including a high frequency circuit unit and a low frequency circuit unit, the antenna apparatus comprising:

a first conductive housing for containing the high frequency circuit unit;

an antenna mounted on said first conductive housing;

a second conductive housing for containing the low frequency circuit unit; and a capacitor electrically and directly connected between said first conductive housing and said second conductive housing with respect to a high frequency, for allowing a predetermined amount of a high frequency current induced by at least one of a transmission and a reception radio signal from said antenna to flow through said first and second conductive housings so as to obtain a predetermined current distribution pattern of the induced high frequency current for improving radiation characteristics of said antenna.

52. An antenna apparatus as claimed in claim 51, wherein said antenna is a ¼λ monopole antenna mounted on an upper surface of said first conductive housing.

53. An antenna apparatus as claimed in claim 51, wherein said antenna comprises a plane antenna mounted on a rear surface of said first conductive housing.

54. An antenna apparatus as claimed in claim 51, wherein said first conductive housing has a first opening for containing the high frequency circuit unit;

said second conductive housing has a second opening for containing the low frequency circuit unit;

said antenna apparatus further comprises:

a circuit connecting line extending into said first and second conductive housings through said first and second openings therein to connect said high frequency and low frequency circuits to each other, said circuit connecting line being arranged so as not to make a high frequency coupling between said first and second conductive housings.

55. An antenna apparatus as claimed in claim 54, further comprising a ¼ wavelength open stub which is connected to said circuit connecting line such that said stub has one end which is connected to said circuit connecting line, and another end which is open in a vicinity of the respective first and second openings.

56. An antenna apparatus as claimed in claim 54, wherein said circuit connecting line comprises an optical fiber.

57. An antenna apparatus as claimed in claim 54, further comprising a conductive sleeve connected to one of said first and second openings, and wherein said circuit connecting line comprises a co-axial cable, one end of which is inserted into said sleeve, and an external conductor one end of which is connected to said sleeve.

58. A portable radio communication apparatus including a transmitter circuit, a receiver circuit, a control circuit, and a resin housing, said apparatus comprising:

a first conductive housing contained in the resin housing, for containing at least one of the transmitter circuit and the receiver circuit;

an antenna mounted on said first conductive housing;

a second conductive housing contained in the resin housing, for containing the control circuit; and a capacitor electrically and directly connected between said first and second conductive housings with respect to a high frequency, for allowing a predetermined amount of a high frequency current induced by at least one of a transmission and a reception radio signal from said antenna to flow through said first and second conductive housings so as to obtain a predetermined current distribution pattern of the induced high frequency current for improving radiation characteristics of said antenna.

59. A portable radio communication apparatus as claimed in claim 58, further comprising:

a speaker mounted on a surface of said resin housing where said first conductive housing is held; and a microphone provided on said resin housing where said second conductive housing is held.

60. A portable radio communication apparatus as claimed in claim 59, wherein:

said antenna comprises a plane antenna, and said plane antenna is mounted on a surface of said resin housing, said surface of said resin housing being located opposite to the surface of said resin housing where the speaker is mounted.

61. A portable radio communication apparatus as claimed in claim 58, wherein:

said first conductive housing is held on a forward side of said second conductive housing within said resin housing.

62. A radio communication apparatus including a high frequency circuit unit, a low frequency circuit unit, a first resin housing, a second resin housing, the first resin housing and the second resin housing being mechanically and foldably connected to each other so as to be in one of an open state and a closed state, the apparatus comprising:

a first conductive housing contained in the first resin housing, for containing the high frequency circuit unit;

an antenna mounted on said first conductive housing;

a second conductive housing contained in the second resin housing, for containing the low frequency circuit unit; and a capacitor electrically and directly connected between said first and second conductive housings with respect to a high frequency, for allowing a predetermined amount of a high frequency current induced by at least one of a transmission and a reception radio signal from said antenna to flow through said first and second conductive housings so as to obtain a predetermined current distribution pattern of the induced high frequency current for improving radiation characteristics of said antenna.

63. A portable radio communication apparatus as claimed in claim 62, further comprising:

a speaker mounted on said first resin housing; and a microphone mounted on said second resin housing.

* * * * *

UNITED STATES PATENT AND TRADEMARK OFFICE

CERTIFICATE OF CORRECTION

PATENT NO. : 5,977,917

DATED : November 2, 1999

INVENTOR(S) : Masanobu HIROSE

It is certified that error appears in the above-indentified patent and that said Letters Patent is hereby corrected as shown below:

In the Drawings, Fig. 6A, change the section line "D-D" to --6B-6B--.

Column 17, line 27 (claim 20, line 1), change "a" to --as--;

Column 19, line 58 (claim 36, line 2), change "claim 31" to --claim 34--.

Signed and Sealed this

Seventeenth Day of April, 2001

*Attest:*

Nicholas P. Godici

NICHOLAS P. GODICI

*Attesting Officer*

*Acting Director of the United States Patent and Trademark Office*